US006143284A

United States Patent [19]

Bush et al.

[11] Patent Number: 6,143,284

[45] Date of Patent: Nov. 7, 2000

[54] PACKAGED ANTIPERSPIRANT CREAM COMPOSITION

[75] Inventors: Stephan Gary Bush; Arthur Harold Dornbusch, both of Cincinnati; Curtis Bobby Motley, West Chester; William Herb Klumb, Mariemont, all of Ohio

[73] Assignee: The Procter & Gamble Company, Cincinnati, Ohio

[21] Appl. No.: 09/054,091

[22] Filed: Apr. 2, 1998

[51] Int. Cl.[7] ..... A61K 7/32; A61K 7/00

[52] U.S. Cl. ..... 424/65; 424/400; 424/401

[58] Field of Search ..... 424/65, 400, 401; 206/438, 823; 271/252, 277

[56] References Cited

U.S. PATENT DOCUMENTS

| | | | |
|---|---|---|---|
| 4,126,679 | 11/1978 | Davy et al. | 424/66 |
| 4,526,780 | 7/1985 | Marschner et al. | 424/66 |
| 4,725,432 | 2/1988 | May | 424/66 |
| 4,749,569 | 6/1988 | Gianino et al. | 424/65 |
| 4,840,789 | 6/1989 | Orr et al. | 424/66 |
| 4,937,069 | 6/1990 | Shin | 424/66 |
| 4,944,937 | 7/1990 | McCall | 424/65 |
| 4,985,238 | 1/1991 | Tanner et al. | 424/66 |
| 4,996,239 | 2/1991 | Matravers | 514/873 |
| 5,000,356 | 3/1991 | Johnson et al. | 222/391 |
| 5,007,755 | 4/1991 | Thompson | 401/175 |
| 5,019,375 | 5/1991 | Tanner et al. | 424/66 |
| 5,069,897 | 12/1991 | Orr | 424/66 |
| 5,102,656 | 4/1992 | Kasat | 424/66 |
| 5,156,834 | 10/1992 | Beckmeyer et al. | 424/47 |
| 5,169,626 | 12/1992 | Tanner et al. | 424/66 |
| 5,292,530 | 3/1994 | McCrea et al. | 424/66 |

FOREIGN PATENT DOCUMENTS

| | | | |
|---|---|---|---|
| 1125659 | 6/1982 | Canada . | |
| 0 135 315 A2 | 3/1985 | European Pat. Off. | A61K 7/32 |
| 2018590 | 10/1979 | United Kingdom . | |
| 92/19215 | 11/1992 | WIPO . | |

OTHER PUBLICATIONS

German Patent Publication DE 4309372 A1 940929 (English Abstract) Derwent, Acc. No. 94–303652, Klier, Schneider, Traupe, Voss, Wolf, Roeckl, Siemanowski, Uhlig, "Deodorants".

Japan Patent Publication JP 52099236 A 770819 (English Abstract) Derwent Acc. No. 77–69889Y, Yoshida, Aoyagi, Nakano, "Antiperspirant".

German Patent Publication DE3150402 A 820708 (English Abstract) Derwent Acc. No. 82–57533E, Marschner, "Quick–drying powder suspensions".

Japanese Patent Publication JP 02056411A (English Abstract) Chem. Abst. Plus., Higuchi, Naoo, "Deodorants for the skin and hair preparations".

*Primary Examiner*—Shelley A. Dodson
*Attorney, Agent, or Firm*—William J. Winter

[57] ABSTRACT

Disclosed is a packaged antiperspirant cream composition comprising a gellant, a liquid carrier, an antiperspirant active, and a dispensing package which contains the antiperspirant cream composition. The packaged antiperspirant cream compositions have improved stability, application aesthetics, and reduced syneresis. The dispensing package comprises 1) a container body having an interior chamber of generally uniform or symmetrical cross section which contains the antiperspirant cream composition and has a lengthwise extending axis, 2) an elevator having a cross section congruent to and mounted for axial movement within the interior chamber, 3) a perforated, convex dome attached to a dispensing end of the container body and having a plurality openings extending through the thickness of the perforated dome, 4) a means for axially advancing the elevator toward the perforated dome; and 5) an optional means for axially reciprocating the elevator away from the convex dome; wherein the means for axially advancing the elevator and the optional means for axially reciprocating the elevator cooperate to reciprocate the elevator a minimum distance $D_{min}$. The dispensing package preferably has a select container body rigidity, a select convex configuration for the perforated dome and supporting elevator, and/or other means for reducing residual internal pressure, all of which help to minimize the development of solvent syneresis from the antiperspirant cream composition.

104 Claims, 2 Drawing Sheets

PACKAGED ANTIPERSPIRANT CREAM COMPOSITION

TECHNICAL FIELD

The present invention relates to packaged antiperspirant cream compositions which provide improved spreading and product stability. In particular, the present invention relates to packaged antiperspirant cream compositions having a select package configuration that provides improved product stability and application performance.

BACKGROUND OF THE INVENTION

There are many types of topical antiperspirant products that are commercially available or otherwise known in the antiperspirant art. Most of these products are formulated as sprays, roll-on liquids, creams, or solid sticks, and comprise an astringent material, e.g. zirconium or aluminum salts, incorporated into a suitable topical carrier. These products are designed to provide effective perspiration and odor control while also being cosmetically acceptable during and after application onto the underarm area or other areas of the skin.

Within this product group, antiperspirant creams have become increasingly more popular as an effective alternative to antiperspirant sprays and solid sticks. These creams can be applied by conventional means, or packaged into topical dispensers to make topical application more efficient and less messy. Perspiration and odor control provided by these products can be excellent. Many of these creams, however, are cosmetically unacceptable to a large number of antiperspirant users. Application of these creams can be messy, difficult to spread and wash off, and even when a cream applicator is employed, the applied areas often feel wet or sticky for several minutes after application. These compositions are especially difficult to uniformly spread over hairy areas of the skin. Many consumers have therefore preferred antiperspirant sticks for ease of administration and drier skin feel immediately after application, although the antiperspirant sticks typically leave an undesirably high residue on the skin.

One method for making improved antiperspirant creams involves the formulation of particulate antiperspirant actives in a mixture of volatile and nonvolatile silicones or other carriers. The use of such volatile solvents in these mixtures helps reduce stickiness, improve dry-own times after application onto skin, improve ease of spreading, and improve wash-off characteristics. To maintain physical stability of these creams, however, inorganic thickening agents such as bentonite clays, hectorite clays, colloidal or fumed silicas are often needed. The inorganic thickening agents, however, contribute a grainy texture to the product and are not especially effective in maintaining physical stability when higher concentrations of volatile silicone or nonsilicone solvents, or lower viscosity nonvolatile silicone or nonsilicone solvents are used. This physical instability results in solvent syneresis (weeping of solvent from the cream matrix) during packaging, storage or shipping.

Product instability in the form of solvent syneresis can be minimized or eliminated in these soft creams by simply formulating the product into a harder, more conventional, antiperspirant stick. Many consumers, however, prefer the lower residue cosmetics associated with the soft creams, especially when these creams are applied with a cream applicator device having a perforated dome through which the soft cream is extruded and applied to the skin. Antiperspirant sticks are too hard to be extruded through most perforated domes, and typically result in higher visible residue on the skin than soft antiperspirant creams.

Other methods of preparing soft antiperspirant creams involve the use of compositions comprising a volatile silicone solvent, suitable gellant, and antiperspirant active, which compositions are prepared by select processing methods. Components of the compositions are mixed together and heated above the melt point of the gellant, and then cooled to below the normal solidification point of the composition while subjecting the composition to continuous mixing or shear. The continuous mixing or shear prevents the product from forming a solid matrix at its normal solidification point, and thus forms a soft creamy matrix with continuous mixing below its normal solidification point. The continuous mixing thus prevents the composition from solidifying into a harder gel stick, and thus transforms it into a soft cream instead. These compositions, however, tend to be physically unstable during storage and result in substantial solvent syneresis during storage, shipping or even during application of the soft cream when applied through a perforated dome.

Recently, antiperspirant creams have been disclosed which do not rely upon the use of inorganic or polymeric thickening agents, and deliver improved cosmetics, product stability, and/or reduced solvent syneresis. These newer creams are typically anhydrous systems which have a penetration force value of from about 75 gram·force to about 500 gram·force, a delta stress value of from about 300 dyne/cm$^2$ to about 8,000 dyne/cm$^2$ as measured after extrusion of the composition through a shear force delivery means, and a static yield stress value of at least about 1,000 dyne/cm$^2$ as measured after extrusion of the composition through a shear force delivery means. These newer creams are soft enough for application through a perforated dome but act as antiperspirant sticks in having minimal or no solvent syneresis during storage. When stress is applied to the new antiperspirant creams, preferably by extruding the cream through a perforated dome or other shear force delivery means, prior to application, the cream becomes more fluid-like and easier to apply topically to the skin. These newer creams are effective at maintaining product stability and minimizing solvent syneresis, especially when used in combination with higher concentrations of volatile solvents or lower viscosity nonvolatile solvents.

It has been found, however, that although these newer antiperspirant creams are remarkably stable and have good spreadability, they are especially susceptible to solvent syneresis or product separation during and after application through a perforated dome or other shear force delivery means, sometimes resulting in weeping of solvent in and around the perforations of the perforated top during storage until the next application It is believed that the solvent syneresis results from residual pressure within the composition remaining after application from a packaged dispenser through a perforated dome.

It has now been found that the solvent syneresis from the above-described creams and other similar compositions can be further minimize or eliminated by selecting a combination of package characteristics that help reduce or eliminate residual pressure, and thus reduce or eliminate solvent syneresis resulting from such residual pressures.

It is therefore an object of the present invention to provide a packaged antiperspirant cream composition with improved stability and spreading performance. It is yet another object of the present invention to provide such a packaged composition wherein the packaged configuration containing the antiperspirant cream composition reduces or eliminates solvent syneresis during or after extrusion of the composition through the perforated dome.

SUMMARY OF THE INVENTION

The present invention is directed to packaged antiperspirant cream compositions, wherein the antiperspirant cream has a force penetration value of from about 75 gram·force to about 500 gram·force and comprises from about 10% to about 80% by weight of a liquid carrier, from about 0.5% to about 35% by weight of an antiperspirant active; and from about 0.1% to about 40% by weight of a gellant. The antiperspirant cream is contained within a dispensing package having the following characteristics:

i) a container body having an interior chamber of generally uniform or symmetrical cross section to contain the antiperspirant cream composition and a lengthwise extending axis, ii) an elevator having a cross section congruent to and mounted for axial movement within the interior chamber, iii) a perforated dome having a convex configuration and being attached to a dispensing end of the container body and having a plurality of openings extending through the thickness of the perforated dome;

iv) a means for axially advancing the elevator toward the perforated dome; and v) optionally, a means for axially reciprocating the elevator away from the perforated dome;

wherein the means for axially advancing the elevator and the optional means for axially reciprocating the elevator cooperate to reciprocate the elevator a minimum distance $D_{min}$ for each predetermined increment of forward axial advancement of the elevator by the means for axially advancing the elevator.

The dispensing packages are selectively configured to minimize residual pressure on the packaged antiperspirant creams during and after extrusion, which then helps to minimize solvent syneresis. The present invention is directed to those compositions comprising select package configurations designed to minimize such residual pressures, such configurations include select 1) minimum retraction distances (Dmin values), 2) stiff or rigid container bodies such that under 3 psi of internal pressure the radius of a minor axis of a cross sectional area of the container body expands DO more than about 0.051cm, 3) convex perforated domes that substantially match the major and minor axis of the elevator or platorm above or on which the antiperspirant cream is positioned, 4) and other select configurations described hererin.

DETAILED DESCRIPTION OF THE INVENTION

Figure 1:
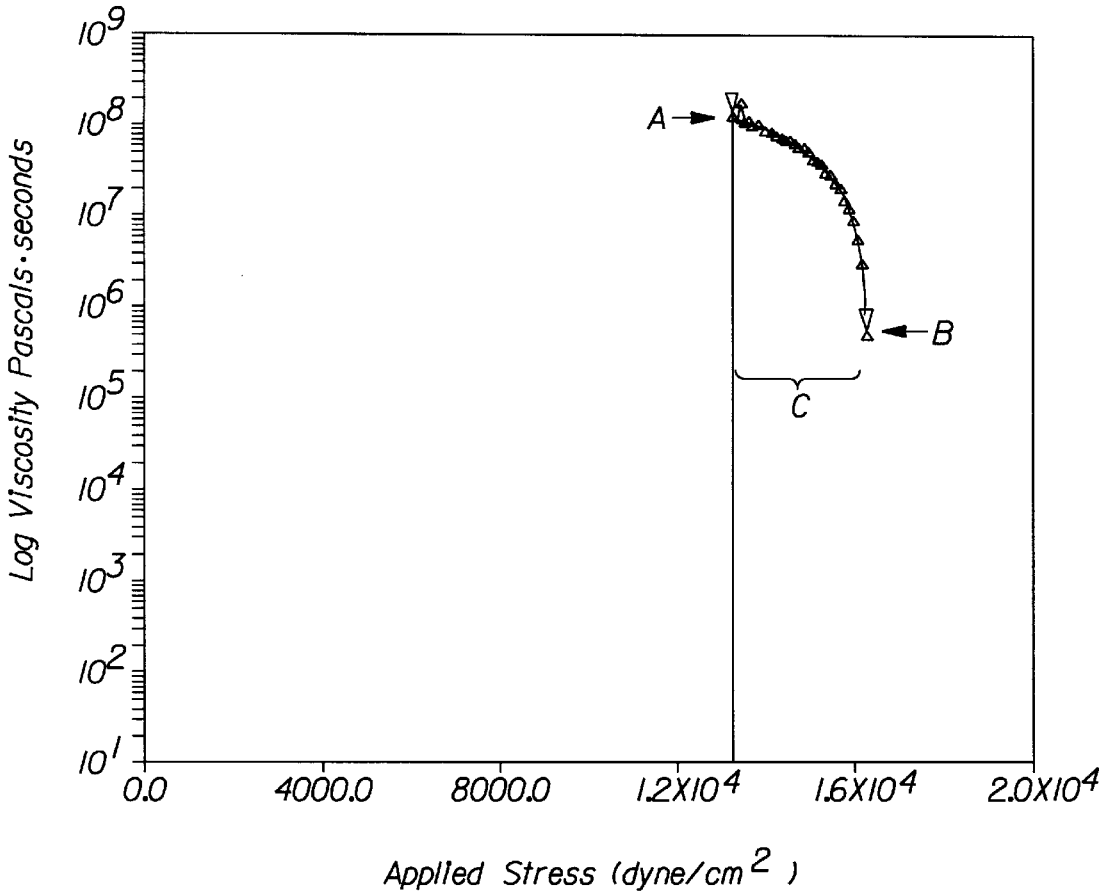
FIG. 1 is a graph which shows the static yield stress and delta stress values of a preferred embodiment of the packaged antiperspirant cream composition of the present invention after extrusion through the perforated dome shown in FIG. 2. The vertical axis represents product viscosity (pascal·sec.) as measured by Rheometrics Dynamic Stress Rheometer. The horizontal axis represents applied stress (dyne/cm$^2$) to the composition. For the sample composition represented by the graph, the graph shows a static yield stress value (point "A" on horizontal axis) of about 13,200 dyne/cm$^2$, a dynamic yield stress value (point "B" on horizontal axis) of about 16,200 dyne/cm$^2$, and a delta stress value (interval "C" of the horizontal axis) of about 3,000 dyne/cm$^2$.

The packaged antiperspirant cream compositions of the present invention contain antiperspirant active dispersed or maintained in a suitable liquid carrier, preferably within a continuous water-insoluble or lipophilic phase. These antiperspirant cream compositions are contained within a dispensing package having a select configuration which is designed to reduce or eliminate solvent syneresis and product separation during and after extrusion of the product from the package.

The term "anhydrous" as used herein means that the antiperspirant cream composition of the present invention, and the essential or optional components thereof, are preferably substantially free of added or free water. From a formulation standpoint, this means that the antiperspirant cream compositions of the present invention preferably contain less than about 2%, preferably less than about 1%, more preferably less than about 0.5%, most preferably zero percent, by weight of free or added water. The preferred "anhydrous liquid carriers" described hereinafter likewise contain no more than the above-described percentages of free or added water.

The terms "shear force delivery means" and "perforated dome" are used interchangeably herein and refer to the convex, perforated dome of the dispensing package herein, which perforated dome comprises a plurality of openings, apertures or orifices (hereinafter referred to collectively as apertures or openings) through which the antiperspirant cream compositions described herein are extruded, and that during such extrusion, the perforated dome subjects the composition to shear that is generally insufficient to substantially liquefy the composition, preferably a shear force less than the dynamic stress value of the composition, more preferably a shear force less than the static stress value of the composition. Examples of such perforated domes or shear force delivery means are described in greater detail hereinafter.

The term "ambient conditions" as used herein refers to surrounding conditions under about one atmosphere of pressure, at about 50% relative humidity, at about 25° C.

The term "substantially free of polymeric or inorganic thickening agents" as used herein refers to preferred embodiments of the compositions of the present invention, and means that the compositions preferably contain less than an effective amount of such agents when used alone to provide any thickening or measurable viscosity increase to the composition. In this context, the polymeric and inorganic thickening agents refer only to materials that are solid under ambient conditions. Generally, the compositions preferably contain less than 5%, more preferably less than 2%, more preferably less than 1%, even more preferably less than 0.5%, most preferably zero percent, of such thickening agents by weight of the composition. Examples of inorganic thickening agents to which the above-described negative but preferred limitations pertain include finely divided or colloidal silicas, fumed silicas, and silicates, which includes montmorillonite clays and hydrophobically treated montmorillonites, e.g., bentonites, hectorites and colloidal magnesium silicates. Examples of polymeric thickening agents to which the above-described negative but preferred limitations also pertain include polymers well known in the antiperspirant or personal care art for use in providing thickening benefits to a composition, specific examples of which include hydrogenated butylene/ethylene/styrene copolymer, polyethylene, acrylic acid polymers, ethylene acrylate copolymers, and other polymeric thickening agents described in Rheological Properties of Cosmetics and Toiletries, Edited by Dennis Laba, published by Marcel Dekker, In., New York (1993), which description is incorporated herein by reference. All such preferably excluded polymeric and inorganic thickening agents are solids under ambient conditions.

The term "cross section" as used herein, unless otherwise specified, refers to a cross section of the container body as defined herein, wherein the cross section is perpendicular to the lengthwise extending axis of the container body.

The packaged antiperspirant cream compositions of the present invention can comprise, consist of, or consist essentially of the essential elements and limitations of the invention described herein, as well as any of the additional or optional ingredients, components, or limitations described herein.

All percentages, parts and ratios are by weight of the total composition, unless otherwise specified. All such weights as they pertain to listed ingredients are based on the active level and, therefore, do not include solvents or by-products that may be included in commercially available materials, unless otherwise specified.

PACKAGED COMPOSITION

The packaged antiperspirant cream composition of the present invention is a combination of the antiperspirant cream composition described herein and a package as defined herein for topically dispensing the antiperspirant cream composition to the underarm or other area of the skin. This combination results in improved spreading of the composition onto the skin, and reduces or eliminates solvent syneresis during and after application of the composition.

The dispensing package of the compositions of the present invention comprises 1) a container body having an interior chamber of generally uniform or symmetrical cross section which contains the antiperspirant cream composition and has a lengthwise extending axis, 2) an elevator having a cross section congruent to and mounted for axial movement within the interior chamber, 3) a perforated dome fixed or attached to a dispensing end of the container body and having a plurality of openings extending through the thickness of the convex dome, 4) a means for axially advancing the elevator toward the perforated dome; and 5) optionally, a means for axially reciprocating the elevator away from the perforated dome wherein the means for axially advancing the elevator and the optional means for axially reciprocating the elevator may cooperate to reciprocate the elevator a minimum distance $D_{min}$ (cm) for each predetermined increment of forward axial advancement of the elevator by the means for axially advancing. The minimum reciprocating distance is determined by either of the expressions $D_{min}=[V_{max}-V_{rest}]/A$ or $D_{min}=k_v\cdot(P_y-Y_s)/A$, each expression being described in detail hereinafter.

The container body of the dispensing package has at least one cross sectional area having a ratio of a major axis to a minor axis of from about 1:1 to about 5:1, preferably from about 1.5:1 to about 4:1, more preferably from about 1.7:1 to about 2.5:1. The internal surface area of the container body is from about 5 $cm^2$ to about 30 $cm^2$, preferably from about 5 $cm^2$ to about 20 $cm^2$, more preferably from about 10 $cm^2$ to about 20 $cm^2$, wherein the internal surface area is the surface area (cm2) of the interior of the package from the top of the elevator to the first edge of the first perforation in the perforated dome.

The container body is preferably a rigid or stiff structure that does not readily expand during extrusion of the antiperspirant cream composition. Preferably, the container body is sufficiently stiff or rigid such that, under 3 psi (pounds per sq. inch) of internal pressure, the radius of a minor axis of a cross sectional area of the container body expands no more than about 0.051 cm, preferably less than 0.015 cm, more preferably less than about 0.010 cm, most preferably zero cm. It has been found that such rigid or stiff structures help to further minimize solvent syneresis during and after extrusion of the antiperspirant cream compositions herein.

The perforated dome of the dispensing package is a convex surface, preferably a rigid surface, having a plurality of apertures extending through the thickness of the dome, and through which the antiperspirant cream composition is extruded and flows to the intended side of application on the skin. The perforated dome is attached or fixed to the dispensing end of the container body, and has a convex configuration that extends away or protrudes from the container body, and which has a major to minor axis ratio of a cross sectional area as described herein for the container body.

The aperture in the perforated dome represent from about 15% to about 80%, preferably from about 30 % to about 60 %, more preferably from about 39% to about 50%, of the surface area of the perforated dome. In this context, the surface area of the perforated dome corresponds to the surface area as seen and measured from a topographical view of the perforated cap. The convex configuration of the perforated dome preferably has a radius of curvature of from about 25 mm to about 127 mm, more preferably from about 57 mm to about 69 mm, for a major dimension; a radius of curvature of preferably from about 12 mm to about 39 mm, more preferably from about 22 mm to about 28 mm for a minor dimension; average aperture area preferably from about 0. 12 $cm^2$ to about 0.50 $cm^2$, more preferably from about 0.2 $cm^2$ to about 0.35 $cm^2$, wherein the aperture areas can have a circular or noncircular configuration, preferably a circular configuration having an average circular diameter preferably from about 1.9 mm to about 2.6 mm, more preferably from about 0.6 mm to about 26 mm; average interstitial spacing preferably from about 0.076 cm to about 0.419 cm; a perforated dome thickness preferably from about 0.25 mm to about 1.53 mm, more preferably from about 0.7 mm to about 0.97 mm; a dome major axis preferably from about 38 mm to about 77 mm, more preferably from about 52 mm to about 69 mm; and a dome minor axis preferably from about 12 mm to about 51 mm, more preferably from about 18 mm to about 40 mm.

The dispensing package also comprises a means for initially pressuring or axially advancing the antiperspirant cream composition within the container body toward the perforated dome to thus force a discrete amount of the antiperspirant cream composition to extrude through the plurality of apertures in the perforated dome and out of the container body. Such means are well known in the packaging and antiperspirant art, and include mechanisms such as feed screws or other similar functioning systems which drive or force an elevator or platform too impel the antiperspirant cream composition in a substantially unidirectional manner toward the perforated dome at the dispensing end of the package. The elevator or platform typically represents the bottom of the dispensing package on or above which the antiperspirant cream composition rests prior to dispensing.

The elevator or platform within the dispensing package preferably has a rounded, convex configuration that substantially matches the rounded, convex configuration of the perforated dome at the dispensing end of the package. The elevator preferably has a minor axis of curvature within about 10°, preferably within about 2°, more preferably within about 1°, of the minor curvature axis of the perforated dome, and a major axis of curvature within about 10°, preferably within about 2°, more preferably within about 1°, of the major curvature axis of the perforated dome. It has been found that substantially matching these two surfaces helps to further reduce solvent syneresis during and after extrusion.

The dispensing package also preferably comprises a means for retracting product from the perforated dome after extrusion, thus reducing or eliminating residual internal pressure. Such means preferably reduces residual internal pressure by at least about 80%, preferably by at least about 90%, preferably by 100%.

Preferred pressure reduction means include reciprocatory mechanisms which retract the impelling elevator or platform a suitable minimum distance after advancing toward the perforated dome and dispensing the desired amount of the composition, thus preferably reducing residual internal pressure on the packaged composition to below the internal pressure threshold at which solvent syneresis occurs. Examples of dispensing packages comprising suitable mechanisms are described in U.S. Pat. No. 5,000,356, issued to Johnson et al. on Mar. 19, 1991, and U.S. Pat. No. 4,865,231, issued to Wiercinski on Sep. 12, 1989, which patents are incorporated herein by reference in their entirety.

A key feature of the dispensing package herein is the extent of internal residual pressure reduction for any given combination of a dispensing package and an antiperspirant cream composition after each incremental and discrete extrusion of antiperspirant cream from the dispensing package. Pressure reduction can be accomplished by retracting the elevator or platform a select minimum retraction distance ($D_{min}$) or a distance exceeding the minimum retraction distance, to reduce the internal residual pressure on the antiperspirant cream composition to below the pressure at which solvent syneresis occurs.

The packaged antiperspirant cream compositions of the present invention have, therefore, a minimum retraction distance ($D_{min}$) to help achieve the desired residual pressure relief, wherein the retraction distance must at be least about, but may also exceed, the Dmin value as defined herein.

The minimum retraction distance ($D_{min}$) as described above can be determined or otherwise characterized by either of two expressions, the first of which is represented by the following expression:

$$D_{min}=(V_{max}-V_{rest})/A$$

wherein $D_{min}$ is the minimum retraction distance (cm), $V_{max}$ is the maximum volumetric deformation ($cm^3$) of the container body during extrusion, $V_{rest}$ is the volumetric deformation ($cm^3$) of the container body prior to extrusion, and "A" is a cross sectional area ($cm^2$) of the container body. The maximum volumetric deformation $V_{max}$ is defined herein as the volumetric difference ($cm^3$) between the volume of the container body during extrusion and the volume of the container body when empty prior to filing, whereas the term "$V_{rest}$" as used herein refers to the volumetric difference ($cm_3$), if any, between the filled and unfilled volume of the container body prior to any extrusion. Both volumetric values are easily measured or otherwise determined for any packaged system herein by the skilled artisan using conventional, routine or otherwise known measurement techniques.

The minimum retraction distance ($D_{min}$) can also be determined for any given packaged antiperspirant cream composition by the following expression:

$$D_{min}=k_v\cdot(P_y-Y_s)/A$$

wherein "A" is a cross sectional area ($cm^2$) of the container body, $k_v$ is the volumetric compliance coefficient ($cm^3$/psi) of the dispensing package, $P_y$ is the product yield pressure (psi), and $Y_s$ is the static yield stress (psi)(defined hereinafter) of the composition.

Methodology: Volumetric Coefficient

The volumetric compliance coefficient ($k_v$) can be determined by injecting a known amount of fluid into the dispensing package and then measuring the resulting internal pressure, all in accordance with the following methodology.

Cast the bottom portion of the container body (elevator removed) of the dispensing package in a soft resin to seal it. The resin should seal the container body sufficiently to maintain the integrity of the container body during testing, but soft enough so as to not impact volumetric deformations of the container body during testing. Insert and seal a flexible membrane into the perforated dome to sufficiently seal the openings in the dome during testing. The flexible membrane should be sufficiently soft and flexible to not significantly affect the volumetric measurements of the container body during testing while also providing a seal sufficient to maintain the integrity of the container body during testing. Drill and tap the container body to accept a fluid connector and pressure transducer, and then connect the pressure transducer to the fluid connector. Connect a syringe to the container body by any method of attachment that does not introduce extra compliance to the system, i.e. do not use flexible hose. The syringe must be sized to approximate at least the maximum volumetric deformation of the container body during normal use.

Fill the resulting scaled system with waiter (ambient temperature) so that there are no air bubbles within the system, and then inject water from the syringe into the container body in 0.1–1 cc increments and record the corresponding internal press resulting therefrom. The volumetric compliance coefficient $k_v$ can then be calculated as the inverse slope of the line defined by the recorded incremental pressure and corresponding injected fluid volumes.

Methodology: Product Yield Pressure

The product yield pressure is the pressure at which the product begins to flow and is a function of both the dispensing package characteristics and product rheology. The product yield pressure (Py) is measured using a dispensing packaging and a tension/compression tester such as an Instron 8511 with a 50 lbf load cell. The dispensing package is placed on the load cell and the package elevator is advanced slowly (0.0635 cm/sec) and the force required to advance the elevator is recorded on suitable data acquisition equipment. The product yield pressure is the measured maximum steady state force required to advance the elevator divided by the dispensing package cross sectional area.

It has been found that solvent syneresis or phase separation of the antiperspirant cream compositions while within the dispensing package can be minimized or eliminated when the antiperspirant cream composition is incorporated into the dispensing package defined herein. Such solvent syneresis or phase separation can occur as a result of residual pressure within the packaged composition after extrusion. This residual pressure can be minimized by reciprocating the advancing elevator away from the perforated dome after extrusion a minimum retraction distance ($D_{min}$)as determined by either of the expressions described hereinabove. It has also been found that, in accordance with either of the expressions described hereinabove, solvent syneresis or product separation of the packaged composition is further minimized or eliminated by increasing the stiffness of the container body (thus decreasing the volumetric compliance coefficient), increasing the open area in the perforated dome (thus decreasing the product yield pressure), and/or by matching the convex configuration of the elevator to conform substantially with the configuration of the convex perforated dome.

RHEOLOGY

The antiperspirant cream compositions of the present invention are preferably anhydrous and preferably have a rheology profile that helps improve product stability and performance. The rheology profile as defined herein is a combination of product hardness (penetration force), delta stress (dyne/cm$^2$) and static yield stress (dynelcm$^2$) values for the antiperspirant cream compositions. Methods for measuring or determining each of these characteristics of the preferred rheology profile are described in detail hereinafter. Rheology methodologies are carried out at 27° C., 15% relative humidity, unless otherwise specified.

1. Methodology: delta stress and static yield stress

To determine delta stress and static stress yield values for the preferred antiperspirant cream compositions of the present invention, the compositions are analyzed using a Rheometrics Dynamic Stress Rheometer (available from Rheometrics Inc., Piscataaany, N.J., U.S.A) with data collection and analysis performed using Rhios software 4.2.2 (also available from Rheometrics Inc., Piscatawany, N.J., U.S.A.). The rheometer is configured in a parallel plate design using a 25 mm upper plate (available as part number LS-PELT-IP25 from Rheometrics Inc., Piscatawany, N.J., U.S.A.). Temperature control is set at 37° C. Analysis of the antiperspirant cream is performed in the "Stress Sweep: steady meep" default test mode. Rheometer settings are initial stress (1.0 dyne/cm$^2$), final stress (63,930 dynelcm$^2$ ), stress increment (100 dyne/cm$^2$ ), and maximum time per data point ( 5 seconds).

The term "static yield stress" as used herein refers to the minimum amount of stress (dyne/cm$^2$) that must be applied to the antiperspirant cream composition to move the upper plate of the Rheometrics Dynamic Stress Rheometer a distance of about 4.2 micro radians, in accordance with the analysis methods described herein. In other words, static yield stress represents the point in a stress sweep analysis (described herein) of a product at which point the rheometer is first capable of measuring product viscosity.

The term "delta stress" as used herein is determined by subtracting the static yield stress from the dynamic yield stress of a composition. The dynamic yield stress is the point at which the measured viscosity begins to rapidly decline. This can be easily determined by finding the last stress value where the increment between stress values is 100 dynes/cm$^2$. In other words, the delta stress of the composition represents the incremental amount of stress that must be applied to the composition, beyond the static yield stress of the composition, to substantially liquefy the composition after extrusion.

The preferred antiperspirant cream compositions of the present invention are first evaluated for rheology characteristics before extrusion (e.g., evaluation of a packaged product) through a defined perforated dome. A 28 gauge metal wire is used to slice of a thin section (about 1 mm thick) from the packaged antiperspirant cream. During and after slicing, care is taken so that the product slice is subjected to minimal shear, and especially that it is not permitted to curl or otherwise reconfigure to a shape other than that of the section as it was removed from the packaged composition The section is carefully placed flat on the lower plate of the rheometer taking care to minimize the application of shear stress on the section during the placement. The area of the placed section is at least about the size of the upper plate to assure proper contact between the two plates during testing. The upper plate is then lowered toward the bottom plate, and positioned about 2 mm above the lower plate, and therefore about 1 mm from the product section which is positioned flat on the lower plate. The upper plate is further lowered at a mninimal rate toward the lower plate, and positioned about 1.000 (±0.002) mm above the lower plate, at which point the product slice is gently positioned between and contacting each of the lower and upper plates. Excess product extending away from and around the parallel positioned plates is gently removed using a spatula, and taking care to subject the product positioned between plates to minimal or no further shear from the spatula The solvent guard pad on the rheometer is saturated with the type of liquid carrier corresponding to that in the test product. The solvent guard is lowered over the parallel plates to prevent solvent loss from the test product that is positioned between the plates during analysis. The product is now ready for rheology analysis and determination of dynamic stress, static yield stress, and delta stress.

The preferred antiperspirant cam compositions are also evaluated for rheology characteristics immediately after the composition is extruded through a perforated dome. The perforated dome used in this analysis has the general configuration of the perforated dome shown in FIG. 2. To prepare product for such an evaluation, the product is first extruded through the perforated dome until from about 1 to about 3 mm of product extends from the exterior of the perforated dome. Gently remove extruded product from the surface of the dome using a spatula and place the removed product in the center of the lower plate, all along being careful to subject the product to minimal or no shear. Product should have an area at least about the size of the upper plate to assure proper contact between the two plate. The upper plate is lowered to about 2 mm, and then at a minimal rate further lowered to about 0.500 (±0.002) mm. Excess product extending away from and around the parallel positioned plates is gently removed using a spatula, and again taking care to subject the product positioned between plates to minimal or no further shear from the spatula. The solvent guard is lowered over the parallel plates to prevent solvent loss during analysis. The solvent guard should be saturated with the selected liquid carrier corresponding to the type of carrier in the test product prior to placement of test product on the instrument. The extruded product thus positioned between the parallel plates is now ready for rheology analysis and determination of dynamic stress, static yield stress, and delta stress.

Product samples before extrusion and product samples after extrusion through the perforated dome are subjected to rheological test and evaluation in accordance with the above described methodology. Data from the above described analysis can be plotted as viscosity (pascal·sec.) on a log scale versus linear applied stress (dyne/cm$^2$), an example of which is shown in FIG. 1 herein. The initial point at which the instrument measures a viscosity is the static yield stress (i.e. the lowest stress at which the instrument shows a non-zero viscosity). The dynamic yield stress is the point at which the measured viscosity begins to rapidly decline. This can be easily determined by finding the last stress value where the increment between stress values is 100 dyne/cm$^2$. The delta stress is then determined by subtracting the static yield stress from the dynamic yield stress.

2. Methodology: product hardness

The antiperspirant cream compositions of the present invention are evaluated for product hardness (gram·force) and defined in terms of force penetration values. The penetration force values are a reflection of how far a defined penetration cone will penetrate through an antiperspirant cream composition under the following test conditions. Higher values represent harder product, and lower values represent softer product These values are measured at 27° C., 15% relative humidity, using a TA-XT2 Texture Analyzer, available from Texture Technology Corp, Scarsdale, N.J., U.S.A. The penetration force value as used herein represents the force required to move a standard 45° angle penetration cone through the composition for a distance of 10 mm at a rate of 2 mm/second. The standard cone is available from Texture Technology Corp., as part number TA-15, and has a total cone length of about 24.7 mm, angled cone length of about 18.3 mm, a maximum diameter of the angled surface of the cone of about 15.5 mm. The cone is a smooth, stainless steel construction and weights about 17.8 grams.

3. Rheology Profile

The antiperspirant cream compositions preferably have a rheology profile as defined by three rheology characteristics—product hardness, static yield stress, and delta stress. As to the first rheology characteristic, the product hardness is characterized as a penetration force value of from about 75 gram force to about 500 gram·force, preferably from about 100 gram·force to about 400 gram force, more preferably from about 150 gram·force to about 250 gram force.

The second preferred rheology characteristic of the antiperspirant cream compositions is a static yield stress value as measured after extrusion of the composition through a shear force delivery means, and preferably as also measured prior to such extrusion. The compositions have a static yield stress value as measured after extrusion of at least about 1,000 dynelcm$^2$, preferably at least about 3,000 dyne/cm$^2$, even more preferably at least about 4,000 dyne/cm$^2$, and most preferably at least about 10,000 dyne/cm$^2$. The composition preferably also has a maximum static yield stress value as measured after extrusion of less than about 63,000 dyne/cm$^2$, more preferably less than about 35,000 dyne/cm$^2$.

The compositions also preferably have a static yield stress value prior to extrusion of at least about 4,000 dyne/cm$^2$, more preferably at least about 8,000 dynelcm$^2$, even more preferably at least about 40,000 dyne/cm$^2$. The maximum static yield stress values for the composition prior to extrusion are preferably less than about 120,000 dyne/cm$^2$, more preferably less than about 63,000 dyne/cm$^2$.

Highly preferred are compositions having a static yield stress value as measured after extrusion of from about 4,000 dyne/cm$^2$ to about 35,000 dyne/cm$^2$. Also highly preferred are compositions having a static yield stress as measured prior to extrusion of from bout 4,000 dyne/cm$^2$ to about 63,000 dyne/cm$^2$.

Products with a static yield stress value below the minimum levels recited herein can shear thin too much prior to application by the end user, or are otherwise physically unstable, especially during extended storage in a closed applicator package or during rough shipping to distributors or consumers. This product instability or excessive thinning of the product matrix can result in solvent syneresis from the composition during packaging, shipping or extended storage.

The second preferred rheology characteristic of the antiperspirant cream compositions is a select range of delta stress values, wherein the delta stress values are measured either prior to or after extrusion through a shear force delivery means. The delta stress value of the composition is from about 300 dyne/cm2 to about 8,000 dyne/cm$^2$, preferably from about 1,000 dyne/cm$^2$ to about 6,000 dyne/cm$^2$, more preferably from about 1,000 dyne/cm$^2$ to about 5,000 dyne/cm$^2$. A delta stress below the minimum level can result in solvent syneresis during extrusion through a perforated dome or other shear force delivery means, whereas a value above the recited maximum can result in product fracture during extrusion, nonuniform spreading onto the skin, and reduced spreadability on the skin, especially on hairy areas of the skin. Syneresis during extrusion of the composition through a perforated dome results in a separated, messy and excessively liquid composition being delivered topically to the skin. The delta stress values, therefore, recited herein provide for improved flow of the antiperspirant cream through a perforated dome or other shear force delivery means, and furthermore provides for a smooth creamy product after extrusion that shows minimal or no solvent syneresis, spreads uniformly over the skin, and spreads especially well over and through hairy areas of the skin.

The compositions of the present invention are preferably characterized in terms of delta stress and yield stress values after extrusion of the composition, although the compositions can alternatively be characterized in terms of delta stress and yield stress values prior to such extrusion. The compositions can also be characterized in terms of delta stress and yield stress values before and after extrusion.

Figure 2A:
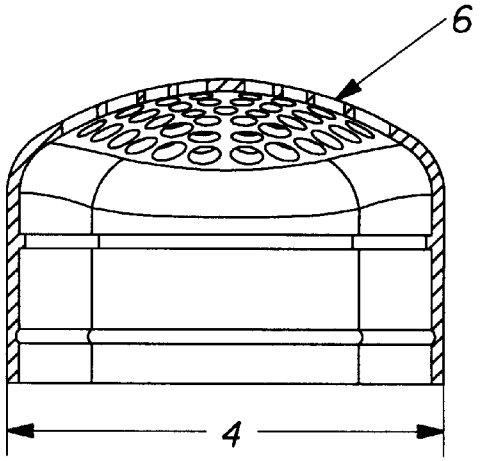
FIGS. 2A, 2B and 2C illustrate a perforated dome suitable for use herein, and which is also used in defining the rheology methodology described herein for defining preferred delta stress and static yield stress values of antiperspirant cream compositions after extrusion through a perforated dome. The illustrated dome has circular apertures (A) having diameters of 2.5, 2.4, and 1.9 mm; aperture spacing (B) of from 0.76 to 1.8 mm; a dome major axis (C) of 52.1 mm; a dome minor axis (D) of 33.0 mm; a dome radius of curvature (E) (major) of 57.1 mm; a dome radius curvature (F) (minor) of 22.9 mm; and a dome thickness (G) of from 0.79 mm to 0.89 mm.
Figure 2B:
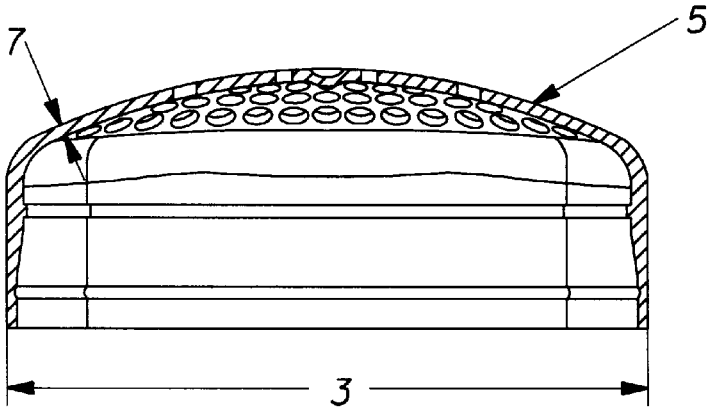
Figure 2C:
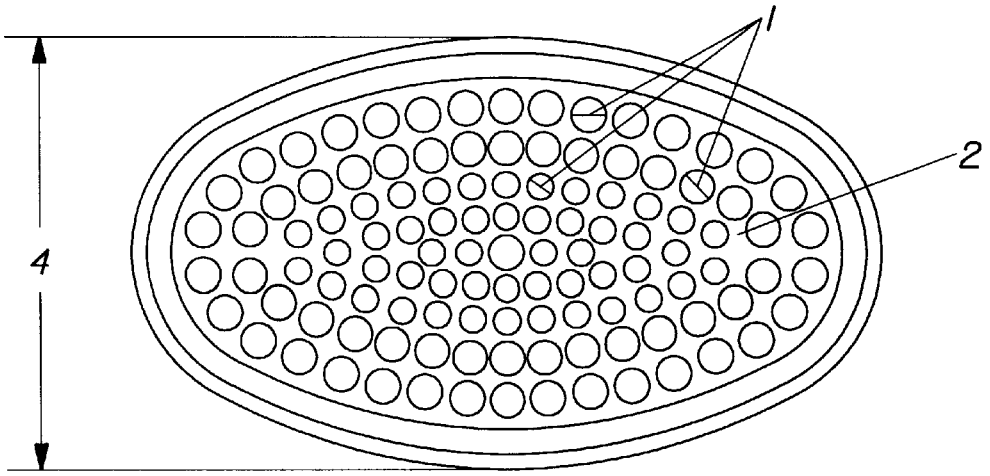

For purposes of defining the preferred embodiments of the present invention, the delta stress and static yield stress characteristics for extruded compositions are measured in accordance with the rheology methodology described herein. Such methodology requires a shear force delivery means having the general perforated dome configuration as illustrated in FIG. 2, wherein the perforated dome has circular apertures in the illustrated configuration having diameters of 2.5, 2.4, and 1.9 mm; aperture spacing of from 0.76 to 1.8 mm; a dome major axis of 52.1 mm; a dome minor axis of 33.0 mm; a dome radius of curvature (major) of 57.1 mm; a dome radius curvature (minor) of 22.9 mm; and a dome thickness of from 0.79 mm to 0.89 mm.

It has been found that by controlling the preferred rheology profile of the antiperspirant cream composition to within the narrow ranges described herein, this provides a means for improving product stability, aesthetics, and performance in an antiperspirant cream composition without reliance on polymeric or inorganic thickening agents.

ANTIPERSPIRANT ACTIVE

The packaged antiperspirant cream compositions of the present invention comprise an antiperspirant active suitable for application to human skin. The antiperspirant active may be solubilized or in the form of particulate solids The antiperspirant active is preferably that which remains substantially unsolubilized as dispersed solid particulates in an anhydrous or substantially anhydrous system. The concentration of active in the composition should be sufficient to provide the desired odor and wetness control from the antiperspirant cream formulation selected.

The antiperspirant cream compositions preferably comprise the antiperspirant active at concentrations of from about 0.5% to about 35%, more preferably from about 5% to about 30%, even more preferably from about 10% to about 26%, by weight of the unpackaged composition. These weight percentages are calculated on an anhydrous metal salt basis exclusive of water and any complexing agents such as glycine, glycine salts, or other complexing agents. The antiperspirant active is preferably in the form of dispersed solid particles having a preferred average particle size or diameter of from about 1 $\mu$m to about 100 $\mu$m, more preferably from about 1 $\mu$m to about 50 $\mu$m.

The antiperspirant active for use in the packaged antiperspirant cream compositions include any compound, composition or other material having antiperspirant activity. Preferred antiperspirant actives include the astringent metallic salts, especially the inorganic and organic salts of aluminum, zirconium and zinc, as well as mixtures thereof. Particularly preferred are the aluminum and zirconium salts, such as aluminum halides, aluminum hydroxyhalides, zireonyl oxyhalides, zirconyl hydroxyhalides, and mixtures thereof.

Preferred aluminum salts for use in the antiperspirant cream composition include those which conform to the formula:

$$Al_2(OH)_a\ Cl_b{\cdot}x\ H_2O$$

wherein a is from about 2 to about 5; the sum of a and b is about 6; x is from about 1 to about 6; and wherein a, b, and x may have non-integer values. Particularly preferred are the aluminum chlorhydroxides referred to as "⅚ basic chlorhydroxide", wherein a=5, and "⅔ basic chlorhydroxide", wherein a=4. Proceses for preparing aluminum salts are disclosed in U.S. Pat. No. 3,887,692, Gilman, issued Jun. 3, 1975; U.S. Pat. No. 3,904,741, Jones et al., issued Sep. 9, 1975; U.S. Pat. No. 4,359,456, Gosling et al., issued Nov. 16, 1982; and British Patent Specification 2,048,229, Fitzgerald et al., published Dec. 10, 1980, all of which are incorporated herein by reference. Mixtures of aluminum salts are described in British Patent Specification 1,347,950, Shin et al., published Feb. 27, 1974, which description is also incorporated herein by reference.

Preferred zirconium salts for use in the antiperspirant cream composition include those which conform to the formula:

$$ZrO(OH)_{2-a}Cl_a{\cdot}x\ H_2O$$

wherein a is from about 1.5 to about 1.87; x is from about 1 to about 7; and wherein a and x may both have non-integer values. These zirconium salts are described in Belgian Patent 825,146, Schmitz, issued Aug. 4, 1975, which description is incorporated herein by reference. Particularly preferred zirconium salts are those complexes which additionally contain aluminum and glycine, commonly known as ZAG complexes. These ZAG complexes contain aluminum chlorhydroxide and zirconyl hydroxy chloride conforming to the above described formulas. Such ZAG complexes are described in U.S. Pat. No. 3,679,068, Luedders et al., issued Feb. 12, 1974; Great Britain Patent Application 2,144,992, Callaghan et al., published Mar. 20, 1985; and U.S. Pat. No. 4,120,948, Shelton, issued Oct. 17, 1978, all of which are incorporated herein by reference.

The antiperspirant cream composition herein can also be formulated to comprise other dispersed solids or other materials in addition to or in place of the antiperspirant active. Such other dispersed solids or other materials include any material known or otherwise suitable for topical application to human skin. The antiperspirant cream composition can also be formulated as a cosmetic cream which contains no active materials, particulate or otherwise.

GELLANT

The packaged antiperspirant cream compositions of the present invention preferably comprise one or more gellants suitable for topical application to human skin. Preferred are those gellants that can form in the composition a crystalline or other gellant matrix within which a liquid carrier or other liquid component of the composition are contained.

The concentration of the gellants in the composition may vary with each selected antiperspirant cream formulation, especially with each selected liquid carrier of the formulation, but such concentrations will generally range from about 0. 1% to about 40%, preferably from about 1% to about 25%, more preferably from about 3% to about 20%, even more preferably from about 3% to about 12%, by weight of the unpackaged composition.

Suitable gellants for use in the composition are typically solids under ambient conditions. These solid gellants preferably have a melting point of from 60° C. to about 140° C., preferably from about 60° C. to about 120° C., more preferably from about 70° C. to about 110° C. The solid gellant will typically and preferably be a crystalline material. Likewise, the gellant matrix in the composition will typically and preferably be a crystalline matrix.

The gellants for use in the antiperspirant cream compositions are preferably those which can melt and form a homogenous liquid or homogenous liquid dispersion with the selected liquid carrier, and at the selected gellant and liquid carrier concentrations, at a processing temperature of from about 28° C. to about 125° C. The melted gellant is typically dispersed throughout the selected liquid carrier to thus form a homogenous liquid. The homogenous liquid, and other essential and optional ingredients, are preferably combined in accordance with the manufacturing method herein, placed in the select package configuration defined hereinbefore as a flowable homogenous liquid, and then allowed to solidify and form the desired gellant matrix within the composition as the temperature returns to ambient temperatures and drops to below the solidification point of the selected gellant In selecting a combination of gellant and liquid carrier for use in the antiperspirant cream compositions, the selected combination preferably allows for the development of a gellant matrix within the composition that will help deliver the preferred delta stress and static yield stress values described herein. The liquid carrier and gellant combination are also preferably selected so as to formulate a composition having the preferred product hardness, with minimal or no destruction of the gellant matrix as it develops within the antiperspirant cream composition during the making process. Maintaining the gellant matrix as it develops in the composition is important to obtaining the desired rheology profile defined herein, especially delta stress and static yield stress values. The liquid carrier and gellant combination are also preferably selected so as to assist in minimizing gellant crystal particle size within the antiperspirant cream composition. Methods for mninimizing gellant particle size in various compositions are known generally in the art, and the control of such particle size to help achieve the desired rheology characteristics is easily accomplished by one of ordinary skill in the art without undue experimentation.

Gellants for use in the antiperspirant composition include fatty alcohols, esters of fatty alcohols, fatty acids, amides of fatty acids, esters or ethers of fatty acids including triglycerides, ethoxylated fatty alcohols, ethoxylated fatty acids, corresponding salts thereof, combinations thereof, and other crystalline gellants known or otherwise effective in providing the desired gellant matrix within the antiperspirant composition. All such gellants preferably have a fatty alkyl moiety having from about 14 to about 60 carbon atoms, more preferably from about 20 to about 40 carbon atoms, and which may be saturated or unsaturated, substituted or unsubstituted, branched or linear or cyclic. Preferred fatty alkyl moieties are saturated, more preferably saturated and unsubstituted The term "substituted" as used herein refers to chemical moieties known or otherwise effective for attachment to gellants or other compounds. Such substituents include those listed and described in C. Hansch and A. Leo, Substituent Constants for Correlation Analysis in Chemistry and Biology (1979), which listing and description are incorporated herein by reference. Examples of such substituents include, but are not limited to, alkyl, alkenyl, alkoxy, hydroxy, oxo, nitro, amino, aminoalkyl (e.g., aminomethyl, etc.), cyano, halo, carooxy, alkoxyaceyl (e.g., carboethoxy, etc.), thiol, aryl, cycloalkyl, heteroaryl, heterocycloalkyl (e.g., piperidinyl, morpholinyl, pyrrolidinyl, etc.), imino, thioxo, hydroxyalkyl, aryloxy, arylalkyl, and combinations thereof.

The term "corresponding salts" as used herein refers to cationic salts formed at any acidic (e.g., carboxyl) group, or anionic salts formed at any basic (e.g., amino) group, either of which are suitable for topical application to human skin. Many such salts are known in the art, examples of which are described in World Patent Publication 87105297, Johnston et al., published Sep. 11, 1987, which description is incorporated herein by reference.

Nonlimiting examples of suitable esters of fatty alcohols include tri-isostearyl citrate, ethyleneglycol di-12-hydroxystearate, tristearylcitrate, stearyl octanoate, stearyl heptanoate, trilaurylcitrate, and combinations thereof.

Suitable fatty alcohols may be used in the composition at concentrations preferably ranging from about 0.1% to about 8%, more preferably from about 3% to about 8%, even more preferably from about 3% to about 6%, by weight of the composition. The fatty alcohol gellants are also preferably saturated, unsubstituted, monohydric alcohols or combinations thereof, which have a melting point preferably less than about 110° C. Specific examples of fatty alcohol gellants for use in the antiperspirant compositions that are commercially available include, but are not limited to, Unilin 550, Unilin 700, Unilin 425, Unilin 400, Unilin 350, and Unilin 325, all supplied by Petrolite.

Suitable ethoxylated gellants include, but are not limited, Unithox 325, Unithox 400, and Unithox 450, Unithox 480, Unithox 520, Unithox 550, Unithox 720, Unithox 750, all of which are available from Petrolite.

Suitable fatty acid esters for use as gellants include ester waxes, monoglycerides, diglycerides, triglycerides and combinations thereof. Preferred are the glyceride esters. Nonlimiting examples of suitable ester waxes including stearyl stearate, stearyl behenate, palmityl stearate, stearyl octyldodecanol, cetyl esters, cetearyl behenate, behenyl bebenate, ethylene glycol distearate, ethylene glycol dipalmitate, beeswax, and combinations thereof. Examples of commercial ester waxes include Kester waxes from Koster Keunen, Crodamol SS from Croda and Demalcare SPS from Rhone Poulenc.

Preferred are glyceryl tribehenate and other triglycerides, wherein at least about 75%, preferably about 100%, of the esterified fatty acid moieties of said other triglycerides each have from about 18 to about 36 carbon atoms, and wherein the molar ratio of glyceryl tribehenate to said other triglycerides is from about 20:1 to about 1:1, preferably from about 10:1 to about 3:1, more preferably from about 6:1 to about 4:1. The esterified fatty acid moieties may be saturated or unsaturated, substituted or unsubstituted, linear or branched, but are preferably linear, saturated, unsubstituted ester moieties derived from fatty acid materials having from about 18 to about 36 carbon atoms. The triglyceride gellant preferably has a preferred melting point of less than about 110° C. Preferred concentrations of the triglyceride gellants in the antiperspirant composition range from about 4% to about 20%, more preferably from about 4% to about 10%, by weight of the composition. Specific examples of preferred triglyceride gellants include, but are not limited to, tristearin, tribehenate, behenyl palmityl behenyl triglyceride, palmityl stearyl palmityl triglyceride, hydrogenated vegetable oil, hydrogenated rape seed oil, castor wax, fish oils, tripalmiten, Syncrowax HRC and Syncrowax HGLC (Syncrowax is available from Croda, Inc.). Other suitable glycerides include, but are not limited to, and glyceryl stearate and glyceryl distearate.

Suitable amide gellants include monoamide gellants, diamide gellants, triamide gellants, and combinations thereof, nonlimiting examples of which include cocoamide MEA (monoethanolamide), stearamide, oleamide, oleamide MEA, tallow amid monoethanolamide, and the n-acyl amino acid amide derivatives described in U.S. Pat. No. 5,429,816, issued to Hofrichter et al. on Jul. 4, 1995, which description is incorporated herein by reference.

Suitable fatty acid gellants include, but are not limited to, 12-hydroxystearic acid and derivatives thereof, behenic acid, eurcic acid, stearic acid, C20 to C40 fatty acids, and related gellants, some preferred examples of which are disclosed in U.S. Pat. No. 5,429,816, issued to Hofrichter et al. on Jul. 4, 1995; and U.S. Pat. No. 5,552,136, issued to Motley on Sep. 3, 1996, both disclosures of which are incorporated by reference herein. Some commercial examples of fatty acid gellants include, but are not limited to, Unicid 400, available from Petrolite.

Preferred crystalline gellants for use in the antiperspirant composition include coconut monoethanolamide, glyceryl tribehenate, C18–36 triglyceride, hydrogenated rapeseed oil, C20 to C40 alcohols, C20 to C40 pareth-3 and combinations thereof. Concentration of coconut monoethanolamide in the composition preferably ranges from about 5% to about 20%, more preferably from about 5% to about 15%, by weight of the composition. Coconut monoethanolamide is especially preferred when used in compositions containing a volatile silicone solvent, especially volatile cyclomethicone, and in compositions containing a combination a volatile silicone carrier and a nonvolatile silicone (e.g., nonvolatile dimethicones) or a nonvolatile organic carrier.

Glyceryl tribehenate and hydrogenated rapeseed oil are also preferred gellants when used in gellant systems containing C20 to C40 fatty alcohols and/or C20 to C40 pareth-3, wherein the weight ratio of glyceryl tribehenate or hydrogenated rapeseed oil to C20 to C40 fatty alcohols and/or C20 to C40 pareth-3 is from about 20:1 to about 1:1, preferably from about 10:1 to about 3:1. These gellants are especially preferred when used in compositions containing volatile silicone carrier, especially volatile cyclomethicone, and in compositions containing a combination of a volatile silicone carrier and a nonvolatile silicone (e.g., nonvolatile dimethicones) or a nonvolatile organic carrier.

Some of the gellants suitable for use in the antiperspirant cream composition herein are also described in U.S. Pat. No. 5,552,136, issued to Motley on Sep. 3, 1996; and U.S. Pat. No. 5,429,816 issued to Hofrichter et al. on Jul. 4, 1995; which descriptions are incorporated herein by reference.

It has been found that the preferred gellants for use in the antiperspirant cream composition of the present invention are those which form a crystalline matrix within the composition, which in turn preferably provides the rheology profile (delta stress, static yield stress, penetration force) described herein. In particular, the preferred gellant should be combined with an appropriate liquid carrier and formulated into the composition so as to form crystallized gellant forming a crystalline matrix, wherein the size of the gellant crystals in the matrix are preferably minimized. It is also desirable that the formulation results in the development of a crystalline matrix within the composition with minimal or no application of any shear force that might otherwise break down the structure of the matrix. Preferred methods for preparing these more desirable crystalline matrices within the composition are described in detail hereinafter.

The gellant material in the composition preferably has an average particle size within the matrix of less than about 10 $\mu$m, more preferably from about 0.1 $\mu$m to about 5 $\mu$m, even more preferably from about 1 $\mu$m to about 4 $\mu$m. It has been found that these smaller crystalline particles are especially effective in developing the preferred rheology model of the composition described herein. These smaller particles form an improved crystalline matrix within which the dispersed particulate antiperspirant active is physically held in place over extended periods, and within which the liquid carrier component of the composition is held with minimal or reduced solvent syneresis during storage, transport and extrusion through a perforated dome.

LIQUID CARRIER

The packaged antiperspirant cream compositions of the present invention comprise a liquid carrier for the gellant as described herinbefore, wherein the liquid carrier is preferably anhydrous and comprises one or more liquid carriers each or collectively having a solubility parameter typically from about 3 to about 13, preferably from about 5 to about 11, more preferably from about 5 to about 9. The term "liquid carrier" and "carrier" are used interchangeably herein, and refer to the liquid carrier component of the composition, which preferably forms a homogenous liquid with the selected gellant during processing as described herein.

Solubility parameters for selected liquid carrier or other materials, and means for determining such parameters, are well known in the antiperspirant art. A description of solubility parameters and means for determining them are described by C. D. Vaughan, "Solubility Effects in Product, Package, Penetration and Preservation" 103 Cosmetics and Toiletries 47–69, October 1988; and C. D. Vaughan, "Using Solubility Parameters in Cosmetics Formulation", 36 J Soc. Cosmetic Chemists 319–333, September/October, 198, which descriptions are incorporated herein by reference.

Concentrations of the liquid carrier in the composition will vary with the type of liquid carrier selected, the type of gellant used in combination with the liquid carrier, the solubility of the selected gellant in the selected carrier, and so forth. Preferred concentrations of the liquid carrier ranges from about 10% to about 80%, preferably from about 20% to about 70%, more preferably from about 45% to about 70%, by weight of the composition.

The liquid carrier comprises one or more liquid carriers suitable for topical application to human skin, which carrier or combination of liquid carriers are liquid under ambient conditions. These liquid carriers may be organic or silicone-containing, volatile or nonvolatile, polar or nonpolar, and preferably provide form a homogenous liquid or homogenous liquid dispersion with the selected gellant at the selected gellant concentration at a temperature of from about 28° C. to about 125° C. The liquid carrier preferably has a low viscosity to provide for improved spreading performance on the skin, more preferably less than about 50 cs (centistokes), even more preferably less than about 10 cs. The liquid carrier is preferably anhydrous.

The liquid carrier preferably comprises one or more volatile carriers, optionally in combination with a nonvolatile carrier. In this context, the term "volatile" refers to criers having a measurable vapor pressure under ambient conditions, and the term "nonvolatile" refers to carriers which do not have a measurable vapor pressure under ambient conditions.

Preferred volatile liquid carriers are the volatile silicone carriers, which includes cyclic, linear or branched chain volatile silicones. Nonlimiting examples of suitable volatile silicones are described in Todd et al., "Volatile Silicone Fluids for Cosmetics", Cosmetics and Toiletries, 91:27–32 (1976), which descriptions are incorporated herein by reference. Preferred volatile silicone materials are those having from about 3 to about 7, more preferably from about 4 to about 5, silicon atoms. Cyclic silicones are preferred.

Suitable cyclic silicones for use in the antiperspirant cream composition include those volatile silicones which conform to the formula:

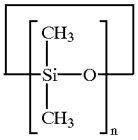

wherein n is from about 3 to about 7, preferably from about 4 to about 5, most preferably 5. These cyclic silicone materials will generally have viscosity values of less than about 10 cs at ° C.

Suitable linear silicones suitable for use in the antiperspirant cream compositions include those volatile linear silicones which conform to the formula:

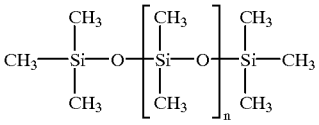

wherein n is from about 1 to about 7, preferably from about 2 to about 3. These linear silicone materials will generally have viscosity values of less than about 5 cs at 25° C.

Specific examples of volatile silicone carriers suitable for use in the antiperspirant compositions include, but are not limited to, Cyclomethicone D-5 (commercially available from G. E. Silicones), Dow Corning 344, Dow Corning 345 and Dow Corning 200 (commercially available it from Dow Corning Corp.), GE 7207 and 7158 (commercially available from General Electric Co.) and SWS-03314 (commercially available from SWS Silicones Corp.).

Other suitable carriers for use in the composition include nonvolatile silicone emollients, preferably low viscosity nonvolatile silicone carriers having a viscosity of less than about 500 cs, more preferably from about 5 cs to about 50 cs, more preferably from about 5 cs to about 20 cs. These silicone emollients include, but are not limited to, polyalkylsiloxanes, polyaryarylsiloxanes and polyethersiloxane copolymers. Examples of such emollients are well known in the art, some of which are described in 1 Cosmetics, Science and Technology 27–104 (M. Balsam and E. Sagarin ed. 1972); U.S. Pat. No. 4,202,879, issued to Shelton on May 13, 1980; and U.S. Pat. No. 5,069,897, issued to Orr on Dec. 3, 1991; which descriptions are incorporated herein by reference.

Organic carriers for use in the composition include saturated or unsaturated, substituted or unsubstituted, branched or linear or cyclic, organic compounds that are also liquid under ambient conditions. These carriers include hydrocarbon oils, alcohols, organic esters and ethers that are liquid under ambient conditions. Preferred organic carriers include mineral oil and other hydrocarbon oils, some examples of which are described in U.S. Pat. No. 5,019,375, issued to Tanner et al. on May 28, 1991, which description is incorporated herein by reference. Other suitable organic liquid carriers include Permethyl 99A, Permethyl 101A (Permethyl available from Permethyl Corp.), Isopar M, Isopar V (Isopar available from Exxon) , isohexadecane, disopropyl adipate, butyl stearate, isododecane, light mineral oil, petrolatum and other similar materials.

Highly preferred are liquid carriers comprising a combination of volatile and nonvolatile silicone carriers, especially when such combinations are also anhydrous. Examples of such preferred combinations are described in U.S. Pat. No. 5,156,834 (Beckmeyer et al.), which descriptions are incorporated herein by reference.

OPTIONAL COMPONENTS

The packaged antiperspirant cream compositions of the present invention may further comprise one or more optional components which may modify the physical or chemical characteristics of the compositions or serve as additional "active" components when deposited on the skin. The compositions may also further comprise optional inert ingredients. Many such optional materials are known in the antiperspirant art and may be used in the packaged antiperspirant compositions herein, provided that such optional materials are compatible with the essential materials described herein, or do not otherwise unduly impair product performance.

Non limiting examples of optional materials include active components such as bacteriostats and fungiostats, and "non-active" components such as colorants, perfumes, emulsifiers, chelants, distributing agents, preservatives, residue masking agents, and wash-off aids. Examples of such optional materials are described in U.S. Pat. No. 4,049,792, Elsnau, issued Sep. 20, 1977; Canadian Patent 1,164,347, Beckmeyer et at., issued Mar. 27, 1984; U.S. Pat. No. 5,019,375, Tanner et al., issued May 28, 1991; and U.S. Pat. No. 5,429,816, Hofrichter et al., issued Jul. 4, 1995; which descriptions are incorporated herein by reference.

METHOD OF MANUFACTURE

The packaged antiperspirant cream compositions of the present invention may be prepared by any known or otherwise effective technique for formulating such compositions, and are preferably formulated by any known or otherwise effective technique which results in an antiperspirant cream composition having the preferred rheology characteristics described hereinbefore,. Application of shear is preferably not applied to the product after its point of solidification. Such methods preferably involve formulation of the essential components of the composition to form a soft cream having the preferred hardness, static yield stress, and delta stress described herein, wherein the gel or crystalline matrix within the soft cream preferably comprises gellant crystals having am average particle diameter that is minimized through methods well known in the formulation art for minimizing crystalline particle size in a composition.

The point of solidification in the manufacturing method herein corresponds to the point at which the composition becomes turbid due to gellant crystallization in the absence of other dispersed solids in the composition, or when the apparent viscosity increases during the solidification process step described herein. In this context, the term "apparent viscosity" means that the viscosity of the composition appears by visual inspection during the solidification step to have increased.

The manufacturing methods preferably result in the formation of crystalline gellant particles having an average particles diameter of less than about 10 $\mu$m, more preferably from about 0.1 $\mu$m to about 5 $\mu$m, even more preferably from about 1 $\mu$m to about 4 $\mu$m. Crystalline particle morphology includes platelets, spheres, needles, and so forth. In this context, the average particle diameter refers to the average particle diameter at about the narrowest section of the crystalline particle.

Crystalline particle size in the preferred embodiments of the present invention can be determined by techniques well known in the art, which includes light microscopy of the composition, wherein the composition is formulated for analysis purposes without antiperspirant active or other solid particulates. Without such reformulation, it is more difficult to distinguish crystalline gellant particle size from particle size contributed from other nongellant particulates. The reformulated composition is then evaluated by light microscopy or other similar method.

Methods for preparing the antiperspirant cream compositions of the present invention include those methods well known in the art for formulating compositions containing small gellant crystalline particles. Such methods include the use of nucleating agents, formulation with select carriers or gellants or carrier/gellant combinations, controlling rates of crystallization including controlling formulation and processing temperatures, and so forth. All such methods should be applied to the formulation to control or minimize gellant crystal particle size to form the desired crystalline matrix of the composition and the desired rheology characteristics arising therefrom.

A preferred method for preparing such a composition comprises a formulation step followed by a controlled solidification step. The formulation step involves preparing a flowable liquid comprising 1) from about 5% to about 35% by weight of a particulate antiperspirant active, from about 0.1% to about 20% by weight of a crystalline gellant, and from about 10% to about 80% of an anhydrous liquid carrier for the crystalline gellant, the anhydrous liquid carrier having a solubility parameter of from about 3 to about 13, preferably a volatile silicone carrier. The process preferably involves thorough mixing together of all of the essential and optional components at the desired temperature while adding minimal amounts of heat or other energy to liquefy and thoroughly mix all of the added ingredients. Processing temperatures will generally range from about 28° C. to about 125° C., more preferably from about 35° C. to about 100° C., even more preferably from about 50° C. to about 90° C, but will vary with the melt profile of the ingredients in the mixture. In this context, the term "liquefy" means that the substantially all of the gellant and carrier material in the composition are melted or arm otherwise in the form of a combined flowable liquid, which combined flowable liquid comprises particulate antiperspirant active substantially uniformly dispersed therethrough.

The second essential step in the preferred method of the making the compositions involves solidification of the liquefied mixture described hereinabove. The solidification preferably involves removal of the composition from any added heat or other energy source, and/or by subjecting the liquefied composition to active cooling. It is desirable that once the solidification process begins, that the liquefied composition is allowed to solidify to the requisite hardness with mninimal or no addition of substantial amounts of shear force, preferably without the addition of any additional shear force. It has been found that the addition of such additional shear force during the solidification step results in a crystalline network that is insufficient to maintain the preferred rheology profile described herein. Such additional shear force can break down the desired crystalline network if applied after the point of solidification, and it is the presence of such a structure crystalline network that is largely responsible for the rheology profile described herein, and the product performance and stability benefits resulting therefrom.

The preferred method may further comprise the addition of optional materials. Such addition is preferably during the formulation step, wherein the essential and optional ingredients are mixed together to form a liquefied admixture. In making the compositions of the present invention, care must be taken to assure that the particulate antiperspirant materials are dispersed relatively uniformly throughout the composition.

METHOD OF USE

The packaged antiperspirant cream compositions of the present invention may then be applied topically to the skin after application from the packaged system defined herein. This method preferably involves application of an effective amount of the antiperspirant cream composition to the underarm or other area of the skin, preferably from about 0.1 gram to about 20 grams, more preferably from about 0.1 gram to about 10 grams, even more preferably from about 0.1 gram to about 1 gram, of the composition to the desired area of the skin. The applied cream is rubbed over the applied surface one or more times during application using the packaged system defined herein until there is little or no visible residue on the applied surface.

These application methods are preferably applied to the desired areas, typically to the underarm or other area of the skin, one to two times daily, preferably once daily, to achieve effective antiperspirant and odor control over an extended period.

It has been found that this method of applying shear stress to the composition of the present invention is especially effective in providing even spreading of the composition to the skin, while providing a liquefying shear stress to the composition. The composition quickly shears after extrusion but during topical application to the skin to a creamy liquid that spreads smoothly and uniformly over the skin, and especially over the skin and through underarm hair. The improved spreading results in improved deodorant and antiperspirant efficacy.

EXAMPLES

The following nonlimiting examples illustrate specific embodiments of the packaged antiperspirant cream compositions of the present invention, including methods of manufacture and use.

Each of the exemplified compositions are prepared by combining all of the listed components and heating the combination to 100° C. with agitation to form a hot liquid. The heated liquid is allowed to cool with agitation until before the point of solidification, at which point the cooled, liquid composition is filled into select dispensing packages as defined herein and allowed to cool without further agitation or other applied shear to form a stiff cream within the corresponding dispensing package.

TABLE 1

| Component | Example 1 | Example 2 | Example 3 | Example 4 | Example 5 |
|---|---|---|---|---|---|
| Cyclomethicone D5[1] | 64.0 | 34.5 | 68.5 | 62.25 | 67.25 |
| Al Zr trichlorohydrex glycinate[2] | 26.0 | 26.0 | 26.0 | 26 | 26 |
| Butyl stearate | 5.0 | 34.5 | — | 5.0 | — |
| C20–C40 alcohols[3] | 4.5 | 4.5 | 5.0 | | |
| Glyceryl tribehenate | — | — | — | 5.0 | 5.0 |
| C18–C36 triglyceride combination[4] | — | — | — | 1.25 | 1.25 |
| Perfume | 0.5 | 0.5 | 0.5 | 0.5 | 0.5 |
| Rheology | | | | | |
| 1. Hardness (gm force) | 170 | 150 | 200 | 170 | 200 |
| 2. Delta stress (dyne/cm2) | | | | | |
| a) before extrusion | 3,800 | 5,300 | 6,800 | 6,100 | 4,200 |
| b) after extrusion | 3,000 | 3,000 | 7,500 | 7,200 | 3,300 |
| 3. Static yield stress (dyne/cm2) | | | | | |
| a) before extrusion | 16,000 | 4,300 | 2,200 | 11,800 | 30,600 |

TABLE 1-continued

| Component | Example 1 | Example 2 | Example 3 | Example 4 | Example 5 |
|---|---|---|---|---|---|
| b) after extrusion | 13,200 | 3,000 | 1,600 | 2,600 | 23,000 |

[1]Cyclic polydimethylsiloxane containing 5 carbons, supplied by G.E. Silicones
[2]Supplied by Westwood Chemical Corporation
[3]Unilin 425 from Petrolite
[4]Syncrowax HGL-C from Croda

TABLE 2

| Component | Example 7 | Example 8 | Example 9 | Example 10 | Example 11 | Example 12 |
|---|---|---|---|---|---|---|
| Cyclomethicone[5] | 34.0 | 62.75 | 62.75 | — | — | 62.75 |
| Dimethicone[6] | — | 5.0 | 5.0 | 5.0 | 69.0 | 5.0 |
| Glyceryl tribehenate | — | — | 5.0 | 5.0 | — | 5.0 |
| C18–36 triglyceride combination[4] | — | — | — | 1.25 | — | — |
| C20–40 alcohols[3] | — | 1.25 | 1.25 | — | 5.0 | — |
| Hydrogenated rapeseed oil[7] | — | 5.0 | — | — | — | — |
| C20–40 Pareth-3[8] | — | — | — | — | — | 1.25 |
| Diisopropyl adipate | — | — | — | 62.75 | — | — |
| Butyl stearate | 30.0 | — | — | — | — | — |
| Cocamide MEA[9] | 10.0 | — | — | — | — | — |
| Perfume | | | | | | |
| Al Zr tri chlorohydrex glycinate[2] | 26.0 | 26.0 | 26.0 | 26.0 | 26.0 | 26.0 |
| Rheology | | | | | | |
| 1. Hardness (gm force) | 218 | 88 | 84 | 117 | 362 | 143 |
| 2. Static yield stress (dyne/cm2) | | | | | | |
| a) before extrusion | 12,700 | 5,300 | 8,300 | 19,550 | 10,200 | 27,200 |
| b) after extrusion | 10,900 | 5,600 | 9,700 | 10,300 | 10,150 | 33,000 |
| 3. Delta stress (dyne/cm2) | | | | | | |
| a) before extrusion | 3,800 | 5,500 | 4,200 | 5,700 | 6,920 | 7,100 |
| b) after extrusion | 2,400 | 4,300 | 2,000 | 3,800 | 5,200 | 6,433 |

[5]Dow Corning 245 Fluid
[6]Dow Coming 200 Fluid 10 Cst viscosity
[7]High Eurcic Acid Hydrogenated Rapeseed Oil from Calgene
[8]Unithox 420 from Petrolite
[9]Coconut monoethanolamide from Mona
[10]Supplied by Westwood Chemical Corporation Each of the exemplified compositions 1–12 are then separately packaged in dispensing packages as defined herein, and which are further described as dispensing packages 1.1 and 1.2 in Table 3. Each of the dispensing packages have rigid container bodies (radius of the minor axis expands less than about 0.01 cm under 3 psi of internal pressure) and provide a $D_{min}$ value also as defined herein. Each of the dispensing packages also has a convex perforated dome and a convex elevator wherein the major curvature axis of the elevator is within about 1° of the major curvature axis of the perforated dome, and the minor curvature axis of the elevator is within about 1° of the minor curvature axis of the perforated dome.

TABLE 3

| Package No. | Container body major axis (cm) | Container body minor axis (cm) | Elevator advancement (cm) | Perforated dome % open area | Cont. body Internal surface area ($cm^2$) |
|---|---|---|---|---|---|
| 1.1 | 6.323 | 2.858 | 0.035 | 42.9 | 15.054 |
| 1.2 | 5.182 | 2.791 | 0.025 | 38.5 | 9.75 |

Each of the packaged systems remain physically stable over extended periods of time, exhibit minimal or no solvent syneresis during or immediately extrusion through a perforated dome. The exemplified compositions are also especially effective in spreading uniformly over the skin, especially over hairy areas of the skin, to provide improved antiperspirant and deodorant efficacy.

What is claimed is:

1. A packaged antiperspirant cream composition having a penetration force value of from about 75 gram·force to about 500 gram·force, wherein the composition comprises:

(a) from about 10% to about 80% by weight of a liquid carrier;

(b) from about 0.5% to about 35% by weight of an antiperspirant active;

(c) from about 0. 1% to about 40% by weight of a gellant; and (d) a dispensing package containing the antiperspirant cream composition, wherein the dispensing package comprises i) a container body having an interior chamber having a lengthwise extending axis and which contains the antiperspirant cream composition, and a cross sectional area of the interior chamber perpendicular to the extending axis having a ratio of a major axis to minor axis of the cross sectional area from about 1.7:1 to about 5:1;

ii) an elevator having a cross section congruent to and mounted for axial movement within the interior chamber;

iii) a perforated dome attached to a dispensing end of the container body and having a plurality openings extending through the thickness of the perforated dome and covering from about 15% to about 80% of the total surface area of the perforated dome; and iv) a means for axially advancing the elevator toward the perforated dome and a means for axially reciprocating the elevator away from the perforated dome, said means for axially advancing the elevator and said means for axially reciprocating the elevator cooperating to retract the elevator away from the perforated dome a minimum distance for each predetermined increment of forward axial advancement of the elevator by the means for axially advancing toward the perforated dome, wherein the minimum retracting distance is determined by the expression $D_{min}=[V_{max}-V_{rest}]/A$ wherein $D_{min}$ is the minimum retracting distance, $V_{max}$ is the maximum volumetric deformation of the container body during extrusion, $V_{rest}$ is the volumetric deformation of the container body prior to extrusion and "A" is the cross sectional area of the container body.

2. The composition of claim 1 wherein the container body has an internal surface area of from about 5 $cm^2$ to about 30 $cm^2$, a ratio of the major axis to minor axis of the cross sectional area of the container body of from about 1.7:1 to about 2.5:1, and wherein the plurality of openings in the perforated dome have a surface area covering from about 30% to about 60% of the total surface area of the perforated dome.

3. The composition of claim 2 wherein the plurality of openings in the perforated dome have a surface area covering from about 39% to about 50% of the total surface area of the perforated dome, and wherein the container body has an internal surface area of from about 10 $cm^2$ to about 20 $cm^2$.

4. The composition of claim 1 wherein the elevator has a convex configuration having a major curvature axis within about 10° of a major curvature axis of the perforated dome, and a minor curvature axis within about 10° of a minor curvature axis of the perforated dome.

5. The composition of claim 1 wherein the container body has a radius of the minor axis which expands no more than about 0.051 cm under 3 psi of internal pressure.

6. The composition of claim 1 wherein the liquid carrier comprises a volatile silicone.

7. The composition of claim 6 wherein the liquid carrier is anhydrous and comprises a combination of volatile and nonvolatile silicones.

8. The composition of claim 6 wherein the gellant is a crystalline gellant which comprises glyceryl tribehenate and other triglycerides wherein at least about 75% of the fatty acid ester moieties of said other triglycerides have from about 18 to about 36 carbon atoms and the molar ratio of glyceryl tribehenate to said other triglycerides is from about 20:1 to about 1:1.

9. The composition of claim 8 wherein the molar ratio of glyceryl tribehenate to said other triglycerides is from about 4:1 to about 6:1.

10. The composition of claim 1 herein the antiperspirant cream composition has a delta stress value of from about 300 dyne/$cm^2$ to about 8,000 dyne/$cm^2$ as measured after extrusion of the composition through a shear force delivery means, and a static yield stress value of at least about 1,000 dynelcm$^2$ as measured after extrusion of the composition through a shear force delivery means.

11. The composition of claim 1 wherein the delta stress value is from about 1,000 dyne/$cm^2$ to about 6,000 dyne/$cm^2$ as measured after extrusion of the composition through a shear force delivery meals, and a static yield stress value of from about 4,000 dyne/$cm^2$ to about 63,000 dyne/$cm^2$ as measured after extrusion of the composition through a shear force delivery means.

12. The composition of claim 1 wherein the delta stress value is from about 1,000 dyne/$cm^2$ to about 5,000 dyne/$cm^2$ as measured after extrusion of the composition through a shear force delivery means and the static yield stress value is from about 4,000 dyne/$cm^2$ to about 35,000 dyne/$cm^2$ as measured after extrusion of the composition through a shear force delivery means.

13. The composition of claim 1 wherein said composition has a static yield stress value of at least about 4,000 dyne/$cm^2$ as measured prior to extrusion through a shear force delivery means, and a delta stress value of from about 300 dyne/$cm^2$ to about 8,000 dyne/$cm^2$ as measured prior to extrusion of the composition through a shear force delivery means.

14. A packaged antiperspirant cream composition having a penetration force value of from about 75 gram·force to about 500 gram·force, wherein the composition comprises:

(a) from about 10% to about 80% by weight of a liquid carrier;

(b) from about 0.5% to about 35% by weight of an antiperspirant active;

(c) from about 0.1% to about 40% by weight of a gellant; and (d) a dispensing package containing the antiperspirant cream composition, wherein the dispensing package comprises i) a container body having an interior chamber having a lengthwise extending axis and which contains the antiperspirant cream composition, and a cross sectional area of the interior chamber perpendicular to the extending axis having a ratio of a major axis to minor axis of the cross sectional area from about 1.7:1 to about 5:1;

ii) an elevator having a cross section congruent to and mounted for axial movement within the interior chamber, iii) a perforated dome attached to a dispensing end of the container body and having a plurality openings extending through the thickness of the perforated dome and covering from about 15% to about 80% of the total surface area of the perforated dome; and a means for axially advancing the elevator toward the perforated dome and a means for axially reciprocating the elevator away from the perforated dome, said means for axially advancing the elevator and said means for axially reciprocating the elevator cooperating to retract the elevator away from the perforated dome a minimum distance for each predetermined increment of forward axial advancement of the elevator by the means for axially advancing toward the perforated dome, wherein minimum retraction distance is determined by the expression $D_{min}=k_v \cdot (P_y-Y_s)/A$ wherein $D_{min}$ is the minimum retracting distance, $k_v$ is the volumetric compliance coefficient, "A" is the cross sectional area of the container body, $P_y$ is the product yield pressure of the antiperspirant cream composition, and $Y_s$ is the static yield stress of the antiperspirant cream composition.

15. The composition of claim 14 wherein the container body has an internal surface area of from about 5 $cm^2$ to about 30 $cm^2$, a ratio of the major axis to minor axis of the cross sectional area of the container body of from about 1.7:1 to about 2.5:1, and wherein the plurality of openings in the perforated dome have a surface area covering from about 30% to about 60% of the total surface area of the perforated dome.

16. The composition of claim 15 wherein the plurality of openings in the perforated dome have a surface area covering from about 39% to about 50% of the total surface area of the perforated dome, and wherein the container body has an internal surface area of from about 10 $cm^2$ to about 20 $cm^2$.

17. The composition of claim 14 wherein the elevator has a convex configuration having a major curvature axis within about 10° of a major curvature axis of the perforated dome, and a minor curvature axis within about 10° of a minor curvature axis of the perforated dome.

18. The composition of claim 14 wherein the container body has a radius of the minor axis which expands no more than about 0.051 cm under 3 psi of internal pressure.

19. The composition of claim 14 wherein the liquid carrier comprises a volatile silicone.

20. The composition of claim 19 wherein the liquid carrier is anhydrous and comprises a combination of volatile and nonvolatile silicone.

21. The composition of claim 19 wherein the gellant is a crystalline gellant which comprises glyceryl tribehenate and other triglycerides wherein at least about 75% of the fatty acid ester moieties of said other triglycerides have from about 18 to about 36 carbon atoms and the molar ratio of glyceryl tribehenate to said other triglycerides is from about 20:1 to about 1:1.

22. The composition of claim 21 wherein the molar ratio of glyceryl tribehenate to said other triglycerides is from about 4:1 to about 6:1.

23. The composition of claim 14 wherein the antiperspirant cream composition has a delta stress value of from about 300 dyne/$cm^2$ to about 8,000 dyne/$cm^2$ as measured after extrusion of the composition through a shear force delivery means, and a static yield stress value of at least about 1,000 dyne/$cm^2$ as measured after extrusion of the composition through a shear force delivery means.

24. The composition of claim 14 wherein the delta stress value is from about 1,000 dyne/$cm^2$ to about 6,000 dyne/$cm^2$ as measured after extrusion of the composition through a shear force delivery means, and a static yield stress value of from about 4,000 dyne/$cm^2$ to about 63,000 dyne/$cm^2$ as measured after extrusion of the composition through a shear force delivery means.

25. The composition of claim 14 wherein the delta stress value is from about 1,000 dyne/$cm^2$ to about 5,000 dyne/$cm^2$ as measured after extrusion of the composition through a shear force delivery means and the static yield stress value is from about 4,000 dyne/$cm^2$ to about 35,000 dyne/$cm^2$ as measured after extrusion of the composition through a shear force delivery means.

26. The composition of claim 14 wherein said composition has a static yield stress value of at least about 4,000 dyne/$cm^2$ as measured prior to extrusion through a shear force delivery means, and a delta stress value of from about 300 dyne/$cm^2$ to about 8,000 dyne/$cm^2$ as measured prior to extrusion of the composition through a shear force delivery means.

27. A packaged antiperspirant cream composition having a penetration force value of from about 75 gram·force to about 500 gram·force, wherein the composition comprises:

(a) from about 10% to about 80% by weight of a liquid carrier, (b) from about 0.5% to about 35% by weight of an antiperspirant active;

(c) from about 0.1% to about 40% by weight of a gellant; and (d) a dispensing package containing the antiperspirant cream composition, wherein the dispensing package comprises i) a container body having an interior chamber having a lengthwise extending axis and which contains the antiperspirant cream composition, and a cross sectional area of the interior chamber perpendicular to the extending axis having a ratio of a major axis to minor axis of the cross sectional area from about 1.1:1 to about 5:1;

ii) an elevator having a cross section congruent to and mounted for axial movement within the interior chamber;

iii) a perforated dome attached to a dispensing end of the container body and having a plurality openings extending through the thickness of the perforated dome and covering from about 39% to about 80% of the total surface area of the perforated dome; and iv) a means for axially advancing the elevator toward the perforated dome and a means for axially reciprocating the elevator away from the perforated dome, said means for axially advancing the elevator and said means for axially reciprocating the elevator cooperating to retract the elevator away from the perforated dome a minimum distance for each predetermined increment of forward axial advancement of the elevator by the means for axially advancing toward the perforated dome, wherein the minimum retracting distance is determined by the expression $D_{min}=[V_{max}-V_{rest}]/A$ wherein $D_{min}$ is the minimum retracting distance, $V_{max}$ is the maximum volumetric deformation of the container body during extrusion, $V_{rest}$ is the volumetric deformation of the container body prior to extrusion and "A" is the cross sectional area of the container body.

28. The composition of claim 27 wherein the container body has an internal surface area of from about 5 $cm^2$ to about 30 $cm^2$, a ratio of the major axis to minor axis of the cross sectional area of the container body of from about 1.7:1 to about 2.5:1, and wherein the plurality of openings in the perforated dome have a surface area covering from about 39% to about 60% of the total surface area of the perforate dome.

29. The composition of claim 28 wherein the plurality of openings in the perforated dome have a surface area covering from about 39% to about 50% of the total surface area of the perforated dome, and wherein the container body has an internal surface area of from about 10 $cm^2$ to about 20 $cm^2$.

30. The composition of claim 27 wherein the elevator has a convex configuration having a major curvature axis within about 10° of a major curvature axis of the perforated dome, and a minor curvature axis within about 10° of a minor curvature axis of the perforated dome.

31. The composition of claim 27 wherein the container body has a radius of the minor axis which expands no more than about 0.051 cm under 3 psi of internal pressure.

32. The composition of claim 27 wherein the liquid carrier comprises a volatile silicone.

33. The composition of claim 32 wherein the liquid carrier is anhydrous and comprises a combination of volatile and nonvolatile silicones.

34. The composition of claim 32 wherein the gellant is a crystalline gellant which comprises glyceryl tribehenate and other triglycerides wherein at least about 75% of the fatty acid ester moieties of said other triglycerides have from about 18 to about 36 carbon atoms and the molar ratio of glyceryl tribehenate to said other triglycerides is from about 20:1 to about 1:1.

35. The composition of claim 34 wherein the molar ratio of glyceryl tribehenate to said other triglycerides is from about 4:1 to about 6:1.

36. The composition of claim 27 wherein the antiperspirant cream composition has a delta stress value of from about 300 dyne/$cm^2$ to about 8,000 dyne/$cm^2$ as measured after extrusion of the composition through a shear force delivery means, and a static yield stress value of at least about 1,000 dyne/$cm^2$ as measured after extrusion of the composition through a shear force delivery means.

37. The composition of claim 27 wherein the delta stress value is from about 1,000 dyne/$cm^2$ to about 6,000 dyne/$cm^2$ as measured after extrusion of the composition through a shear force delivery means, and a static yield stress value of from about 4,000 dyne/$cm^2$ to about 63,000 dyne/$cm^2$ as measured after extrusion of the composition through a shear force delivery means.

38. The composition of claim 27 wherein the delta stress value is from about 1,000 dyne/$cm^2$ to about 5,000 dyne/$cm^2$ as measured after extrusion of the composition through a shear force delivery means and the static yield stress value is from about 4,000 dyne/$cm^2$ to about 35,000 dyne/$cm^2$ as measured after extrusion of the composition through a shear force delivery means.

39. The composition of claim 27 wherein said composition has a static yield stress value of at least about 4,000 dyne/$cm^2$ as measured prior to extrusion through a shear force delivery means, and a delta stress value of from about 300 dyne/$cm^2$ to about 8,000 dyne/$cm^2$ as measured prior to extrusion of the composition through a shear force delivery means.

40. A packaged antiperspirant cream composition having a penetration force value of from about 75 gram·force to about 500 gram·force, wherein the composition comprises:

(a) from about 10% to about 80% by weight of a liquid carrier;

(b) from about 0.5% to about 35% by weight of an antiperspirant active;

(c) from about 0.1% to about 40% by weight of a gellant; and (d) a dispensing package containing the antiperspirant cream composition, wherein the dispensing package comprises i) a container body having an interior chamber having a lengthwise extending axis and which contains the antiperspirant cream composition, and a cross sectional area of the interior chamber perpendicular to the extending axis having a ratio of a major axis to minor axis of the cross sectional area from about 1.1:1 to about 5:1;

ii) an elevator having a cross section congruent to and mounted for axial movement within the interior chamber;

iii) a perforated dome attached to a dispensing end of the container body and having a plurality openings extending through the thickness of the perforated dome and covering from about 39% to about 80% of the total surface area of the perforated dome; and iv) a means for axially advancing the elevator toward the perforated dome and a means for axially reciprocating the elevator away from the perforated dome, said means for axially advancing the elevator and said means for axially reciprocating the elevator cooperating to retract the elevator away from the perforated dome a minimum distance for each predetermined increment of forward axial advancement of the elevator by the means for axially advancing toward the perforated dome, wherein minimum retraction distance is determined by the expression $D_{min}=k_v\cdot(P_y-Y_s)/A$ wherein $D_{min}$ is the minimum retracting distance, $k_v$ is the volumetric compliance coefficient, "A" is the cross sectional area of the container body, $P_y$ is the product yield pressure of the antiperspirant cream composition, and $Y_s$ is the static yield stress of the antiperspirant cream composition.

41. The composition of claim 40 wherein the container body has an internal source area of from about 5 $cm^2$ to about 30 $cm^2$, a ratio of the major axis to minor axis of the cross sectional area of the container body of from about 1.1:1 to about 2.5:1, and wherein the plurality of openings in the perforated dome have a surface area covering from about 39% to about 60% of the total surface area of the perforated dome.

42. The composition of claim 41 wherein the plurality of openings in the perforated dome have a surface area covering from about 39% to about 50% of the total surface area of the perforated dome, and wherein the container body has an internal surface area of from about 10 $cm^2$ to about 20 $cm^2$.

43. The composition of claim 40 wherein the elevator has a convex configuration having a major curvature axis within about 10° of a major curvature axis of the perforated dome, and a minor curvature axis within about 10° of a minor curvature axis of the perforated dome.

44. The composition of claim 40 wherein the container body has a radius of the minor axis which expands no more than about 0.051 cm under 3 psi of internal pressure.

45. The composition of claim 40 wherein the liquid carrier comprises a volatile silicone.

46. The composition of claim 45 wherein the liquid carrier is anhydrous and comprises a combination of volatile and nonvolatile silicone.

47. The composition of claim 45 wherein the gellant is a crystalline gellant which comprises glyceryl tribehenate and other triglycerides wherein at least about 75% of the fatty acid ester moieties of said other triglycerides have from about 18 to about 36 carbon atoms and the molar ratio of glyceryl tribebenate to said other triglycerides is from about 20:1 to about 1:1.

48. The composition of claim 47 wherein the molar ratio of glyceryl tribehenate to said other triglycerides is from about 4:1 to about 6:1.

49. The composition of claim 40 wherein the antiperspirant cream composition has a delta stress value of from about 300 dyne/cm$^2$ to about 8,000 dyne/cm$^2$ as measured after extrusion of the composition through a shear force delivery means and a static yield stress value of at least about 1,000 dyne/cm$^2$ as measured after extrusion of the composition through a shear force delivery means.

50. The composition of claim 40 wherein the delta stress value is from about 1,000 dyne/cm$^2$ to about 6,000 dyne/cm$^2$ as measured after extrusion of the composition through a shear force delivery means, and a static yield stress value of from about 4,000 dyne/cm$^2$ to about 63,000 dyne/cm$^2$ as measured after extrusion of the composition through a shear force delivery means.

51. The composition of claim 40 wherein the delta stress value is from about 1,000 dyne/cm$^2$ to about 5,000 dyne/cm$^2$ as measured after extrusion of the composition through a shear force delivery means and the static yield stress value is from about 4,000 dyne/cm$^2$ to about 35,000 dyne/cm$^2$ as measured after extrusion of the composition through a shear force delivery means.

52. The composition of claim 40 wherein said composition has a static yield stress value of at least about 4,000 dyne/cm$^2$ as measured prior to extrusion through a shear force delivery means, and a delta stress value of from about 300 dyne/cm$^2$ to about 8,000 dyne/cm$^2$ as measured prior to extrusion of the composition through a shear force delivery means.

53. A packaged antiperspirant cream composition having a penetration force value of from about 75 gram·force to about 500 gram·force, wherein the composition comprises::

(a) from about 10% to about 80% by weight of a liquid carrier;

(b) from about 0.5% to about 35% by weight of antiperspirant active;

(c) from about 0.1% to about 40% by weight of a gellant; and (d) a dispensing package containing the antiperspirant cream composition, wherein the dispensing package comprises i) a container body having an interior chamber having a lengthwise extending axis and which contains the antiperspirant cream composition, and a cross sectional area of the interior chamber perpendicular to the extending axis having a ratio of a major axis to minor axis of the cross sectional area from about 1:1 to about 5:1;

ii) a perforated dome attached to a dispensing end of the container body and having a plurality openings extending through the thickness of the perforated dome and covering from about 15% to about 80% of the total surface area of the perforated dome;

iii) an elevator having a cross section congruent to and mounted for axial movement within the interior chamber, said elevator having a convex configuration having a major curvature axis within about 10° of a major curvature axis of the perforated dome, and a minor curvature axis within about 10° of a minor curvature axis of the perforated dome; and iv) a means for axially advancing the elevator toward the perforated dome.

54. The composition of claim 53 wherein the major curvature axis of the elevator is within about 1° of the major curvature axis of the perforated dome, and the minor curvature axis of the elevator is within about 1° of the minor curvature axis of the perforated dome.

55. The composition of claim 53, wherein the dispensing package further comprises a means for axially reciprocating the elevator away from the perforated dome, said means for axially advancing the elevator and said means for axially reciprocating the elevator cooperating to retract the elevator away from the perforated dome a minimum distance for each predetermined increment of forward axial advancement of the elevator by the means for axially advancing toward the perforated dome.

56. The composition of claim 55 wherein the minimum retracting distance is determined by the expression $D_{min}=[V_{max}-V_{rest}]/A$ wherein $D_{min}$ is the minimum retracting distance, $V_{max}$ is the maximum volumetric deformation of the container body during extrusion, $V_{rest}$ is the volumetric deformation of the container body prior to extrusion and "A" is the cross sectional area of the container body.

57. The composition of claim 56 wherein the container body has an internal surface area of from about 5 cm$^2$ to about 30 cm$^2$, a ratio of the major axis to minor axis of the cross sectional area of the container body of from about 1.7:1 to about 2.5:1, and wherein the plurality of openings in the perforated dome have a surface area covering from about 30% to about 60% of the total surface area of the perforated dome.

58. The composition of claim 56 wherein the plurality of openings in the perforated dome have a surface area covering from about 39% to about 50% of the total surface area of the perforated dome, and wherein the container body has an internal surface area of from about 10 cm$^2$ to about 20 cm$^2$.

59. The composition of claim 55 wherein the minimum retraction distance is determined by the expression $D_{min}=k_v\cdot(P_y-Y_s)/A$ wherein $D_{min}$ is the minimum retracting distance, $k_v$ is the volumetric compliance coefficient, "A" is the cross sectional area of the container body, $P_y$ is the product yield pressure of the antiperspirant cream composition, and $Y_s$ is the static yield stress of the antiperspirant cream composition.

60. The composition of claim 59 wherein the container body has an internal surface area of from about 5 cm$^2$ to about 30 cm$^2$, a ratio of the major axis to minor axis of the cross sectional area of the container body of from about 1.7:1 to about 2.5:1, and wherein the plurality of openings in the perforated dome have a surface area covering from about 30% to about 60% of the total surface area of the perforated dome.

61. The composition of claim 59 wherein the plurality of openings in the perforated dome have a surface area covering from about 39% to about 50% of the total surface area of the perforated dome, and wherein the container body has an internal surface area of from about 10 cm$^2$ to about 20 cm$^2$.

62. The composition of claim 53 wherein the container body has a radius of the minor axis which expands no more than about 0.051 cm under 3 psi of internal pressure.

63. The composition of claim 53 wherein the liquid carrier comprises a volatile silicone.

64. The composition of claim 60 wherein the liquid carrier is anhydrous and comprises a combination of volatile and nonvolatile silicone.

65. The composition of claim 53 wherein the gellant is a crystalline gellant which comprises glyceryl tribehenate and other triglycerides wherein at least about 75% of the fatty acid ester moieties of said other triglycerides have from about 18 to about 36 carbon atoms and the molar ratio of glyceryl tribehenate to said other triglycerides is from about 20:1 to about 1:1.

66. The composition of claim 62 wherein the molar ratio of glyceryl tribehenate to said other triglycerides is from about 4:1 to about 6:1.

67. The composition of claim 53 wherein the antiperspirant cream composition has a delta stress value of from about 300 dyne/cm$^2$ to about 8,000 dyne/cm$^2$ as measured after extrusion of the composition through a shear force delivery means, and a static yield stress value of at least about 1,000 dyne/cm$^2$ as measured after extrusion of the composition through a shear force delivery means.

68. The composition of claim 53 wherein the delta stress value is from about 1,000 dyne/cm$^2$ to about 6,000 dyne/cm$^2$ as measured after extrusion of the composition through a shear force delivery means, and a static yield stress value of from about 4,000 dyne/cm$^2$ to about 63,000 dyne/cm$^2$ as measured after extrusion of the composition through a shear force delivery means.

69. The composition of claim 53 wherein the delta stress value is from about 1,000 dyne/cm$^2$ to about 5,000 dyne/cm$^2$ as measured after extrusion of the composition through a shear force delivery means and the static yield stress value is from about 4,000 dyne/cm$^2$ to about 35,000 dyne/cm$^2$ as measured after extrusion of the composition through a shear force delivery means.

70. The composition of claim 53 wherein said composition has a static yield stress value of at least about 4,000 dyne/cm$^2$ as measured prior to extrusion through a shear force delivery means, and a delta stress value of from about 300 dyne/cm$^2$ to about 8,000 dyne/cm$^2$ as measured prior to extrusion of the composition through a shear force delivery means.

71. A packaged antiperspirant cream composition having a penetration force value of from about 75 gram·force to about 500 gram·force, wherein the composition comprises:

(a) from about 10% to about 80% by weight of a liquid carrier;

(b) from about 0.5% to about 35% by weight of an antiperspirant active;

(c) from about 0. 1% to about 40% by weight of a gellant; and (d) a dispensing package containing the anhydrous antiperspirant cream composition, wherein the dispensing package comprises:

i) a container body having an interior chamber having a lengthwise extending axis and which contains the antiperspirant cream composition, and a cross sectional area of the interior chamber perpendicular to the extending axis having a ratio of a major axis to minor axis of the cross sectional area from about 1:1 to about 5:1, said container body having a radius of the minor axis which expands no more than about 0.051 cm under 3 psi of internal pressure;

ii) a perforated dome attached to a dispensing end of the container body and having a plurality openings extending through the thickness of the perforated dome and covering from about 15% to about 80% of the total surface area of the perforated dome;

iii) an elevator having a cross section congruent to and mounted for axial movement within the interior chamber; and iv) a means for axially advancing the elevator toward the perforated dome;

wherein the antiperspirant cream composition within the dispensing package has a penetration force value of from about 75 gram·force to about 500 gram·force.

72. The composition of claim 71 wherein the container body has a radius of the minor axis which expands less than about 0.01 cm under 3 psi of internal pressure.

73. The composition of claim 71, wherein the dispensing package further comprises a means for axially reciprocating the elevator away from the perforated dome, said means for axially advancing the elevator and said means for axially reciprocating the elevator cooperating to retract the elevator away from the perforated dome a minimum distance for each predetermined increment of forward axial advancement of the elevator by the means for axially advancing toward the perforated dome.

74. The composition of claim 73 wherein the minimum retracting distance is determined by the expression $D_{min}=[V_{max}-V_{rest}]/A$ wherein $D_{min}$ is the minimum retracting distance, $V_{max}$ is the maximum volumetric deformation of the container body during extrusion, $V_{rest}$ is the volumetric deformation of the container body prior to extrusion and "A" is the cross sectional area of the container body.

75. The composition of claim 74 wherein the container body has an internal surface area of from about 5 cm$^2$ to about 30 cm$^2$, a ratio of the major axis to minor axis of the cross sectional area of the container body of from about 1.7:1 to about 2.5:1, and wherein the plurality of openings in the perforated dome have a surface area covering from about 30% to about 60% of the total surface area of the perforated dome.

76. The composition of claim 74 wherein the plurality of openings in the perforated dome have a surface area covering from about 39% to about 50% of the total surface area of the perforated dome, and wherein the container body has an internal surface area of from about 10 cm$^2$ to about 20 cm$^2$.

77. The composition of claim 73 wherein the minimum retraction distance is determined by the expression $D_{min}=k_v\cdot(P_y-Y_s)/A$ wherein $D_{min}$ is the minimum retracting distance, $k_v$ is the volumetric compliance coefficient, "A" is the cross sectional area of the container body, $P_y$ is the product yield pressure of the antiperspirant cream composition, and $Y_s$ is the static yield stress of the antiperspirant cream composition.

78. The composition of claim 77 wherein the container body has an internal surface area of from about 5 cm$^2$ to about 30 cm$^2$, a ratio of the major axis to minor axis of the cross sectional area of the container body of from about 1.7:1 to about 2.5:1, and wherein the plurality of openings in the perforated dome have a surface area covering from about 30% to about 60% of the total surface area of the perforated dome.

79. The composition of claim 77 wherein the plurality of openings in the perforated dome have a surface area covering from about 39% to about 50% of the total surface area of the perforated dome, and wherein the container body has an internal surface area of from about 10 cm$^2$ to about 20 cm$^2$.

80. The composition of claim 71 wherein the liquid carrier comprises a volatile silicone.

81. The composition of claim 80 wherein the liquid carrier is anhydrous and comprises a combination of volatile and nonvolatile silicone.

82. The composition of claim 80 wherein the gellant is a crystalline gellant which comprises glyceryl tribehenate and other triglycerides wherein at least about 75% of the fatty acid ester moieties of said other triglycerides have from about 18 to about 36 carbon atoms and the molar ratio of glyceryl tribehenate to said other triglycerides is from about 20:1 to about 1:1.

83. The composition of claim 82 wherein the molar ratio of glyceryl tribehenate to said other triglycerides is from about 4:1 to about 6:1.

84. The composition of claim 71 wherein the antiperspirant cream composition has a delta stress value of from about 300 dyne/cm$^2$ to about 8,000 dyne/cm$^2$ as measured after extrusion of the composition through a shear force delivery means, and a static yield stress value of at least about 1,000 dyne/cm$^2$ as measured after extrusion of the composition through a shear force delivery means.

85. The composition of claim 71 wherein the delta stress value is from about 1,000 dyne/cm$^2$ to about 6,000 dyne/cm$^2$ as measured after extrusion of the composition through a shear force delivery means, and a static yield stress value of from about 4,000 dyne/cm$^2$ to about 63,000 dyne/cm$^2$ as measured after extrusion of the composition through a shear force delivery means.

86. The composition of claim 71 wherein the delta stress value is from about 1,000 dyne/cm$^2$ to about 5,000 dyne/cm$^2$ as measured after extrusion of the composition through a shear force delivery means and the static yield stress value is from about 4,000 dyne/cm$^2$ to about 35,000 dyne/cm$^2$ as measured after extrusion of the composition through a shear force delivery means.

87. The composition of claim 71 wherein said composition has a static yield stress value of at least about 4,000 dyne/cm$^2$ as measured prior to extrusion through a shear force delivery means, and a delta stress value of from about 300 dyne/cm$^2$ to about 8,000 dyne/cm$^2$ as measured prior to extrusion of the composition through a shear force delivery means.

88. A packaged anhydrous antiperspirant cream composition comprising:

(a) from about 20% to about 80% by weight of a volatile silicone material;

(b) from about 5% to about 35% by weight of a particulate antiperspirant active;

(c) from about 0.1% to about 20% by weight of a crystalline gellant which comprises glyceryl tribehenate and other triglycerides wherein at least about 75% of the fatty acid ester moieties of said other triglycerides have from about 18 to about 36 carbon atoms and the molar ratio of glyceryl tribehenate to said other triglycerides is from about 20:1 to about 1:1 and the penetration force value of the composition ranges from about 75 gram·force to about 500 gram·force; and (d) a dispensing package containing the composition, wherein the dispensing package comprises i) a container body having an interior chamber having a lengthwise extending axis and which contains the antiperspirant cream composition, and a cross sectional area of the interior chamber perpendicular to the extending axis having a ratio of a major axis to minor axis of the cross sectional area from about 1.7:1 to about 5:1;

ii) an elevator having a cross section congruent to and mounted for axial movement within the interior chamber;

iii) a perforated dome attached to a dispensing end of the container body and having a plurality openings extending through the thickness of the perforated dome and covering from about 15% to about 80% of the total surface area of the perforated dome;

iv) a means for axially advancing the elevator toward the perforated dome; and v) a means for axially reciprocating the elevator away from the perforated dome, said means for axially advancing the elevator and said means for axially reciprocating the elevator cooperating to retract the elevator away from the perforated dome a minimum distance for each predetermined increment of forward axial advancement of the elevator by the means for axially advancing toward the perforated dome.

89. The composition of claim 88 wherein the minimum retracting distance is determined by the expression $D_{min}=[V_{max}-V_{rest}]/A$ wherein $D_{min}$ is the minimum retracting distance, $V_{max}$ is the maximum volumetric deformation of the minor axis of the container body during extrusion, $V_{rest}$ is the volumetric deformation of the minor axis of the container body prior to extrusion and "A" is the cross; sectional area of the container body.

90. The composition of claim 89 wherein the container body has an internal surface area of from about 5 cm$^2$ to about 30 cm$^2$, a ratio of the major axis to minor axis of the cross sectional area of the container body of from about 1.7:1 to about 2.5:1, and wherein the plurality of openings in the perforated dome have a surface area covering from about 30% to about 60% of the total surface area of the perforated dome.

91. The composition of claim 90 wherein the plurality of openings in the perforated dome have a surface area covering from about 39% to about 50% of the total surface area of the perforated dome, and wherein the container body has an internal surface area of from about 10 cm$^2$ to about 20 cm$^2$.

92. The composition of claim 2 wherein the elevator has a convex configuration having a major curvature axis within about 10° of a major curvature axis of the perforated dome, and a minor curvature axis within about 10° of a minor curvature axis of the perforated dome.

93. The composition of claim 5 wherein the major curvature axis of the elevator is within about 1° of the major curvature axis of the perforated dome, and the minor curvature axis of the elevator is within about 1° of the minor curvature axis of the perforated dome.

94. The composition of claim 2 wherein the container body has a radius of the minor axis which expands no more than about 0.051 cm under 3 psi of internal pressure.

95. The composition of claim 88 wherein the molar ratio of glyceryl tribehenate to said other triglycerides is from about 4:1 to about 6:1.

96. The composition of claim 88 wherein the minimum retraction distance is determined by the expression $D_{min}=k_v\cdot(P_y-Y_s)/A$ wherein $D_{min}$ is the minimum retracting distance, $k_v$ is the volumetric compliance coefficient, "A" is the cross sectional area of the container body, $P_y$ is the product yield pressure of the antiperspirant cream composition, and $Y_s$ is the static yield stress of the antiperspirant cream composition.

97. A packaged anhydrous antiperspirant cream composition comprising:

(a) from about 20% to about 80% by weight of a volatile silicone material;

(b) from about 5% to about 35 % by weight of a particulate antiperspirant active;

(c) from about 0.1% to about 20% by weight of a crystalline gellant which comprises glyceryl tribehenate and other triglycerides wherein at least about 75% of the fatty acid ester moieties of said other triglycerides have from about 18 to about 36 carbon atoms and the molar ratio of glyceryl tribehenate to said other triglycerides is from about 20:1 to about 1:1 and the penetration force value of the composition ranges from about 75 gram·force to about 500 gram·force; and (d) a dispensing package containing the composition, wherein the dispensing package comprises i) a container body having an interior chamber having a lengthwise extending axis and which contains the antiperspirant cream composition, and a cross sectional area of the interior chamber perpendicular to the extending axis having a ratio of a major axis to minor axis of the cross sectional area from about 1:1 to about 5:1;

ii) an elevator having a cross section congruent to and mounted for axial movement within the interior chamber;

iii) a perforated dome attached to a dispensing end of the container body and having a plurality openings extending through the thickness of the perforated dome and covering from about 39% to about 80 % of the total surface area of the perforated dome;

iv) a means for axially advancing the elevator toward the perforated dome; and v) a means for axially reciprocating the elevator away from the perforated dome, said means for axially advancing the elevator and said means for axially reciprocating the elevator cooperating to retract the elevator away from the perforated dome a minimum distance for each predetermined increment of forward axial advancement of the elevator by the means for axially advancing toward the perforated dome.

98. The composition of claim 97 wherein the minimum retracting distance is determined by the expression $D_{min}=[V_{max}-V_{rest}]/A$ wherein $D_{min}$ is the minimum retracting distance, $V_{max}$ is the maximum volumetric deformation of the minor axis of the container body during extrusion, $V_{rest}$ is the volumetric deformation of the minor axis of the container body prior to extrusion and "A" is the cross sectional area of the container body.

99. The composition of claim 98 wherein the container body has an internal surface area of from about 5 $cm^2$ to about 30 $cm^2$, a ratio of the major axis to minor axis of the cross sectional area of the container body of from about 1.7:1 to about 2.5:1, and wherein the plurality of openings in the perforated dome have a surface area covering from about 39% to about 50% of the total surface area of the perforated dome.

100. The composition of claim 97 wherein the container body has an internal surface area of from about 10 $cm^2$ to about 20 $cm^2$.

101. The composition of claim 97 wherein the major curvature axis of the elevator is within about 1° of the major curvature axis of the perforated dome, and the minor curvature axis of the elevator is within about 1° of the minor curvature axis of the perforated dome.

102. The composition of claim 97 wherein the container body has a radius of the minor axis which expands no more than about 0.051 cm under 3 psi of internal pressure.

103. The composition of claim 97 wherein the molar ratio of glyceryl tribehenate to said other triglycerides is from about 4:1 to about 6:1.

104. The composition of claim 97 wherein the minimum retraction distance is determined by the expression $D_{min}=k_v\cdot(P_y-Y_s)/A$ wherein $D_{min}$ is the minimum retracting distance, $k_v$ is the volumetric compliance coefficient, "A" is the cross sectional area of the container body, $P_y$ is the product yield pressure of the antiperspirant cream composition, and $Y_s$ is the static yield stress of the antiperspirant cream composition.

* * * * *

UNITED STATES PATENT AND TRADEMARK OFFICE

CERTIFICATE OF CORRECTION

PATENT NO. : 6,143,284
DATED : November 7, 2000
INVENTOR(S) : S.G. Bush et al.

It is certified that error appears in the above-identified patent and that said Letters Patent is hereby corrected as shown below:

Column 26,
Line 21, "dynelcm$^2$" should read -- dyne/cm$^2$ --.
Line 26, "meals" should read -- means --.

Column 31,
Line 3, "tribebenate" should read -- tribehenate --.

Signed and Sealed this

Twenty-second Day of March, 2005

JON W. DUDAS
*Director of the United States Patent and Trademark Office*